US012396611B2

(12) United States Patent
Zalaznik et al.

(10) Patent No.: US 12,396,611 B2
(45) Date of Patent: Aug. 26, 2025

(54) HIGH-DUMP HOPPER FOR FLOOR CLEANING MACHINE AND METHOD FOR CLEANING A FLOOR

(71) Applicant: Nilfisk A/S, Broendby (DK)

(72) Inventors: Stephen G. Zalaznik, Maple Grove, MN (US); Corry P. Gunderson, Rogers, MN (US)

(73) Assignee: Nilfisk A/S, Copenhagen (DK)

( * ) Notice: Subject to any disclaimer, the term of this patent is extended or adjusted under 35 U.S.C. 154(b) by 341 days.

(21) Appl. No.: 17/792,635

(22) PCT Filed: Jan. 29, 2021

(86) PCT No.: PCT/DK2021/050030

§ 371 (c)(1),
(2) Date: Jul. 13, 2022

(87) PCT Pub. No.: WO2021/151447

PCT Pub. Date: Aug. 5, 2021

(65) Prior Publication Data

US 2023/0044575 A1 Feb. 9, 2023

Related U.S. Application Data

(60) Provisional application No. 62/968,052, filed on Jan. 30, 2020.

(51) Int. Cl.

| | |
|---|---|
| ***A47L 11/40*** | (2006.01) |
| ***A47L 11/28*** | (2006.01) |
| ***A47L 11/292*** | (2006.01) |

(52) U.S. Cl.

CPC ..... *A47L 11/4013* (2013.01); *A47L 11/292* (2013.01); *A47L 11/28* (2013.01)

(58) Field of Classification Search

CPC .. A47L 11/4013; A47L 11/4025; A47L 11/28; A47L 11/282; A47L 11/283;

(Continued)

(56) References Cited

U.S. PATENT DOCUMENTS 3,304,572 A * 2/1967 Wendel ..... A47L 11/4025 15/340.1
3,761,988 A * 10/1973 Overton ..... E01H 1/047 15/83

(Continued)

FOREIGN PATENT DOCUMENTS

AU 2017200031 A1 7/2017
CA 2144175 A1 3/1994

(Continued)

OTHER PUBLICATIONS

Translation of WO 2019149343 A1 (Year: 2019).*

(Continued)

*Primary Examiner* — David S Posigian
*Assistant Examiner* — Steven Huang
(74) *Attorney, Agent, or Firm* — Dicke, Billig & Czaja, PLLC

(57) ABSTRACT

Systems and methods include a high dump hopper system wherein a debris hopper can be split into two hoppers for positioning adjacent a wheel of the floor cleaning machine. The hoppers, split or not, can be located near the front of the machine such that the overall length of the floor cleaning machine need not be extended. A splitter can be positioned proximate the floor cleaning mechanism to drive debris into the split hoppers. The hoppers, split or not, can be coupled to a common lifting system that can pull the hoppers out from under a chassis of the floor cleaning machine and then upwards for positioning relative to a refuse container. Furthermore, the orientation of the hoppers can be controlled to (Continued)

position openings for the hoppers in a desired location to prevent spilling and facilitate emptying.

22 Claims, 17 Drawing Sheets

(58) Field of Classification Search
CPC ..... A47L 11/30; A47L 11/302; A47L 11/307; A47L 11/4052; A47L 11/4055; A47L 11/4058; A47L 11/201; A47L 11/402; A47L 11/4008; A47L 11/4011; A47L 11/40; A47L 11/145; A47L 11/18; A47L 11/185; A47L 11/292; E01H 1/04; E01H 1/045; E01H 1/047; B08B 1/34; A01D 43/0635; A01D 34/71; B60P 1/04; B60P 1/32; B60P 1/34; B60P 1/16; B60P 1/283; B65F 3/26
See application file for complete search history.

(56) References Cited

U.S. PATENT DOCUMENTS

| | | | | |
|---|---|---|---|---|
| 4,099,285 | A | 7/1978 | Christensen et al. | |
| 4,571,771 | A | 2/1986 | Worwa | |
| 4,708,723 | A | 11/1987 | Howeth | |
| 4,819,676 | A * | 4/1989 | Blehert | A47L 11/4044 15/348 |
| 5,027,464 | A * | 7/1991 | Knowlton | E01H 1/0854 15/83 |
| 5,072,485 | A | 12/1991 | Young et al. | |
| 5,239,720 | A | 8/1993 | Wood et al. | |
| 5,588,179 | A | 12/1996 | Bargiel et al. | |
| 5,996,173 | A * | 12/1999 | Engel | E01H 1/047 15/340.1 |
| 6,742,219 | B2 | 6/2004 | Lenzmeier et al. | |
| 7,448,114 | B2 | 11/2008 | Basham et al. | |
| 8,209,809 | B2 | 7/2012 | Davis et al. | |
| 8,458,855 | B2 | 6/2013 | Wilmo | |
| 9,649,002 | B1 * | 5/2017 | Pollack | A47L 11/4083 |
| 2005/0055786 | A1 * | 3/2005 | Nowak | A47L 11/24 15/83 |
| 2011/0120072 | A1 * | 5/2011 | Fukumoto | A01D 43/0635 56/202 |
| 2018/0028034 | A1 * | 2/2018 | Kistler | E01H 1/0845 |
| 2019/0150356 | A1 | 5/2019 | Gray et al. | |

FOREIGN PATENT DOCUMENTS

| | | | | |
|---|---|---|---|---|
| CN | 100563543 | C | 12/2009 | |
| CN | 109477317 | A | 3/2019 | |
| EP | 0175946 | A2 | 4/1986 | |
| JP | 3146563 | B2 | 3/2001 | |
| WO | 2006121783 | A1 | 11/2006 | |
| WO | WO-2019149343 | A1 * | 8/2019 | A47L 11/24 |

OTHER PUBLICATIONS

International Search Report and Written Opinion from PCT Application Serial No. PCT/DK2021/050030, dated Apr. 22, 2021, 13 pages.

* cited by examiner

HIGH-DUMP HOPPER FOR FLOOR CLEANING MACHINE AND METHOD FOR CLEANING A FLOOR

CROSS-REFERENCE TO RELATED APPLICATION(S)

This application claims the benefit of U.S. Provisional Application No. 62/968,052 filed Jan. 30, 2020 for "HIGH-DUMP HOPPER FOR FLOOR CLEANING MACHINE AND METHOD FOR CLEANING A FLOOR" by S. Zalaznik and C. Gunderson.

TECHNICAL FIELD

The present application relates generally, but not by way of limitation, to floor cleaning machines. More particularly, the present application relates to systems and methods for emptying waste containers of floor cleaning machines that become filled during a floor cleaning operation.

BACKGROUND

Industrial and commercial floors are cleaned on a regular basis for aesthetic and sanitary purposes. There are many types of industrial and commercial floors ranging from hard surfaces, such as concrete, terrazzo, wood, and the like, which can be found in factories, schools, hospitals, and the like, to softer surfaces, such as carpeted floors found in restaurants and offices. Different types of floor cleaning equipment, such as scrubbers and sweepers, have been developed to properly clean and maintain these different floor surfaces.

A typical scrubber is a walk-behind or drivable, self-propelled, wet process machine that applies a liquid cleaning solution from an onboard cleaning solution tank onto the floor through nozzles fixed to a forward portion of the scrubber. Rotating brushes forming part of the scrubber rearward of the nozzles agitate the solution to loosen dirt and grime adhering to the floor. The dirt and grime become suspended in the solution, which is collected by a vacuum squeegee fixed to a rearward portion of the scrubber and deposited into an onboard recovery tank.

Scrubbers can be very effective for cleaning hard surfaces. Unfortunately, debris on the floor can clog the vacuum squeegee, and thus, the floor should be swept prior to using the scrubber. Consequently, sweepers are commonly used to sweep a floor prior to using a scrubber. A typical sweeper is a self-propelled, walk-behind or drivable dry process machine which picks debris off a hard or soft floor surface without the use of liquids. The typical sweeper has rotating brushes which sweep debris into a hopper or "catch bin."

Combination scrubber-sweepers have been developed that provide the sweeping and scrubbing functionality in a single unit. In some scrubber machines, the bristles provide a sweeping action where debris can be collected in a hopper similar to a sweeper. Whether combined into a single unit or split into different cleaning machines, waste collected in the recovery tank and debris hopper can be emptied at regular intervals to facilitate further cleaning operations and prevent unsanitary conditions.

Example floor cleaning machines are described in U.S. Pat. No. 7,448,114 to Basham et al., entitled "Floor Sweeping and Scrubbing Machine"; U.S. Pat. No. 5,588,179 to Bargiel et al., entitled "Dust Box Emptying Device"; U.S. Pat. No. 5,239,720 to Wood et al., entitled "Mobile Surface Cleaning Machine"; and U.S. Pat. No. 4,099,285 to Christensen et al., entitled "High Lift Surface Maintenance Machine."

SUMMARY

In a first aspect, the disclosure relates to a floor cleaning machine comprising: a chassis comprising: a forward end; a rear end; an upper side extending between the forward end and the rear end; and an underside extending between the forward end and the rear end opposite the upper side; an operator station mounted on the upper side; a propulsion system located on the chassis and configured to move the chassis in a travel direction, the propulsion system comprising: a forward steered wheel located on a forward axis coupled to the underside of the chassis; and a rear wheel located on a rear axis coupled to the underside of the chassis; a brush coupled to the underside of the chassis, the brush extending from a first brush end to a second brush end along a brush axis, wherein the brush is configured to rotate about the brush axis; and a hopper system located to the chassis, the hopper system comprising a first debris hopper disposed forward of the brush in a stowed position; wherein the forward axis is positioned in front of the brush axis.

BRIEF DESCRIPTION OF THE FIGURES

The disclosure will now be described in more detail with regard to the accompanying figures. The figures show one way of implementing the present disclosure and is not to be construed as being limiting to other possible embodiments falling within the scope of the attached claim set.

DETAILED DESCRIPTION

Figure 1:
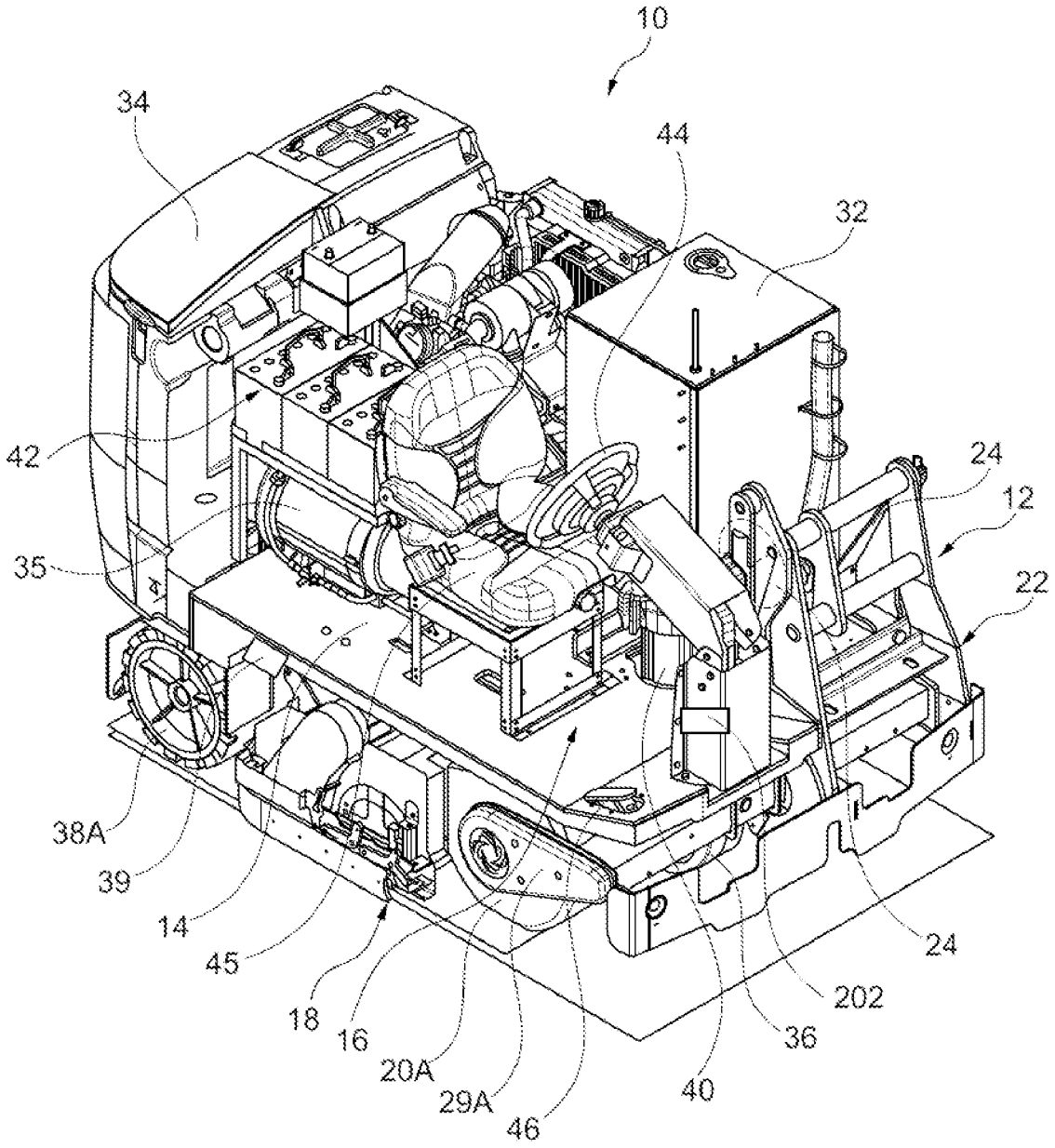
FIG. 1 is a perspective view of a floor cleaning machine including a high dump hopper system.

The present inventors have recognized, among other things, that problems to be solved in performing floor cleaning operations include the need to have to continually empty debris hoppers. After sweeping or scrubbing for a period of time, debris hoppers used to collect debris gathered by the sweeper need to be emptied before becoming too full and impeding the effectiveness of the sweeper. Sometimes emptying of a debris hopper may be needed before a sweeping operation is complete. Emptying of the debris hopper can be a laborious and tedious operation, which slows the overall floor cleaning operation.

Furthermore, the present inventors have recognized that previous solutions to automatically emptying a debris hopper involved locating the debris hopper on the rear of the machine, which provides difficulties for the operator of the machine to steer the floor cleaning machine to a refuse container and empty the container, or involve complex mechanisms that either extend the length of the floor cleaning machine or are overly complicated in requiring the sweeping mechanism to additionally be lifted.

Thus, in accordance with the mentioned problems, it may be seen as an object of the present disclosure to provide a floor cleaning machine which provides an easy and time saving way of emptying its debris hopper, still with the floor cleaning machine having compact dimensions.

The present disclosure is directed to systems and methods for emptying waste containers, such as debris hoppers, used on floor cleaning machines. One or more debris hoppers can be connected to a lift system that can move the debris hoppers from a stowed position underneath the machine proximate a floor cleaning device, e.g., a brush, to an extended position where the debris hoppers are elevated to a level suitable for emptying the debris hoppers above a refuse container, thereby saving an operator having to manually remove the debris hoppers. The lift system can be located at a front of the floor cleaning machine to provide line-of-sight for an operator. The lift system can additionally extend the debris hoppers forward from underneath the machine and upward to above the machine to facilitate a compact design.

Such floor cleaning machine is advantageous, since having a steered wheel in front of the brush allows the operator to have a good view and to be able to easily steer the machine for emptying the front located debris hopper, e.g. a high dump hopper emptying process. Hereby, the debris hopper emptying operation is facilitated, and can be performed less time consuming than with prior art floor cleaning machines.

Further, with such design, the machine can be built with compact dimension, meaning that it has a good maneuverability in cleaning operations and occupies only a limited space when parked.

Especially, the present subject matter can provide solutions to the mentioned problems and other problems, such as by providing systems and methods that include a high dump hopper system wherein the debris hopper can be split into two hoppers for positioning adjacent a wheel of the floor cleaning machine. The split hoppers can be located near the front of the machine such that the overall length of the floor cleaning machine need not be extended. A splitter can be positioned proximate the floor cleaning mechanism to drive debris into the split hoppers. The split hoppers can be coupled to a common lifting system that can pull the hoppers out from under a chassis of the floor cleaning machine and then upwards for positioning relative to a refuse container. Furthermore, the orientation of the hoppers can be controlled to position openings for the hoppers in a desired location to prevent spilling and facilitate emptying.

In the following, preferred features and embodiments will be described.

By 'travel direction' is understood a direction which the floor cleaning machine is arranged to move along a surface to be cleaned, e.g. a floor. This travel direction can be changed by turning the forward steered wheel.

The brush axis is preferably perpendicular to the travel direction, at least when the floor cleaning machine is moving in a straight forward direction, i.e. in a travel direction which is parallel with a longitudinal axis of the chassis formed between the forward and rear ends of the chassis. The brush may be located between the forward axis and the rear axis. Especially, the first debris hopper is located adjacent the forward axis, and more specifically the hopper system further comprises a second debris hopper located adjacent the forward axis. Especially, the first debris hopper and the second debris hopper are spaced apart alongside the forward axis to provide space that allows the forward steered wheel to turn. Especially, the first debris hopper and the second debris hopper may extend across less than a width of the brush. With such first and second debris hoppers, a compact and easily steerable floor cleaning machine is provided.

In some embodiments, the floor cleaning machine comprises a lift system coupled to the chassis, the lift system comprising: a lift link pivotably coupled to the chassis proximate a first end of the lift link and pivotably coupled to the first debris hopper proximate a second end of the lift link; and a first actuator coupled to the chassis proximate a third end of the first actuator and the lift link proximate a fourth end of the first actuator, the first actuator configured to move the first debris hopper from the stowed position to a deployed position in front of and above the chassis. Especially, the lift system may further comprise a crossmember to which the first debris hopper and the second debris hopper are mounted, the crossmember comprising a front end and a back end; wherein the second end of the lift link is pivotably connected proximate the front end of the crossmember; and wherein the first debris hopper and the second debris hopper are connected proximate the back end of the crossmember. More specifically, the lift system may further comprise a follower link pivotably coupled to the chassis proximate a fifth end of the follower link and pivotably coupled to the crossmember proximate a sixth end of the follower link. More specifically, the follower link may comprise a straight first section extending from the first end; and a curved second section extending from the first straight section and extending to the second end. More specifically, the follower link may comprise a straight third section extending from the fifth end; and a curved fourth section extending from the straight third section and extending to the sixth end. Especially, a straight-line distance of the follower link between pivot points may be greater than a straight-line distance of the lift link between pivot points. Specifically, the first end of the lift link may be coupled to the chassis forward of the fifth end of the follower link; and the second end of the lift link may be coupled to the cross member at a different position from the sixth end of the follower link.

In some embodiments, the lift system comprises a second actuator connecting the crossmember and the lift link. Especially, the floor cleaning machine may further comprise a splitter positioned above and in front of the brush between the first debris hopper and the second debris hopper, the splitter configured to direct debris from the brush that is below and behind the splitter into the first and second debris hoppers. Specifically, the splitter may comprise a wedge-shaped body spanning a distance between the first debris hopper and the second debris hopper. Especially, the floor cleaning machine may further comprise a motor mounted to the hopper system, the motor configured to rotate the first and second debris hoppers about a hopper axis. Specifically, the first and second debris hoppers may each comprise: a first end wall; a second end wall spaced from the first end wall along the hopper axis; and a hopper wall extending between the first end wall and the second end wall to define a debris space; wherein the hopper wall defines a cross-sectional area configured to permit the first debris hopper to rotate in place along the hopper axis when rotated by the motor in the stowed position. Specifically, the first and second debris hoppers may each comprise a scupper configured to extend from the first end wall toward the wedge-shaped body to provide clearance for the forward steered wheel. Especially, the first and second debris hoppers may each further comprise: an access opening extending between the first end wall and the second end wall; and a lip extending along the access opening and extending toward the brush in the stowed position.

In some embodiments, the chassis comprises a frame for locating the first end of the lift link above the upper side of the chassis. In some embodiments, the lift link is located laterally of the operator station. In some embodiments, the operator station is located on the upper side of the chassis above or forward of the brush. The lift system may be configured to pull the first debris hopper along a first trajectory in a forward direction and then along a second trajectory in a forward and upward direction. The floor cleaning machine may further comprise an additional brush coupled to the chassis and positioned alongside the brush, wherein the additional brush and the brush are configured to lift debris between them.

In some embodiments, the hopper system comprises a second debris hopper disposed forward of the brush, and further comprises: a splitter positioned above and in front of the brush between the first debris hopper and the second debris hopper, the splitter configured to direct debris from the brush behind the splitter into the first and second debris hoppers. Especially, the first and second debris hoppers may be configured to be slid laterally away from the chassis. Specifically, the floor cleaning machine may further comprise a lift system configured to pull the first and second debris hoppers along a first trajectory in a forward direction and then along a second trajectory in a forward and upward direction. Specifically, the first trajectory extends from under the chassis to in front of the chassis. Especially, the operator station may be located on the upper side of the chassis forward of the rear axis. Especially, the first and second debris hoppers may be located adjacent the forward axis. Specifically, the first debris hopper and the second debris hopper may be spaced apart alongside the forward axis to provide space that allows the forward steered wheel to turn. Especially, the first debris hopper and the second debris hopper may extend across less than a width of the brush. Specifically, the splitter may comprise a wedge-shaped body spanning a distance between the first debris hopper and the second debris hopper.

More specifically, the wedge-shaped body may comprise: first and second leading panels that come together to define an apex; first and second coupling panels extending from the first and second leading panels, respectively, wherein the first and second coupling panels are parallel to teach other; and a bottom wall that is curved to fit over the brush. Especially, the first debris hopper and the second debris hopper may each comprise: a first end wall; a second end wall spaced from the first end wall along the hopper axis; and a hopper wall extending between the first end wall and the second end wall to define a debris space. Specifically, the first and second debris hoppers each further comprise a scupper configured to extend from the first end wall toward the wedge-shaped body to provide clearance for the forward steered wheel. Especially, the first and second debris hoppers may each further comprise: an access opening extending between the first end wall and the second end wall; and a lip extending along the access opening and extending toward the brush.

In some embodiments, the floor cleaning machine comprises: a motor for rotating the first debris hopper about a hopper axis; and a controller coupled to the motor to control rotation of the first debris hopper. Especially, the floor cleaning machine may further comprise a lift system coupled to the chassis, the lift system comprising: a lift link pivotably coupled to the chassis proximate a first end of the lift link and pivotably coupled to the first debris hopper proximate a second end of the lift link; and a first actuator coupled to the chassis proximate a third end of the first actuator and the lift link proximate a fourth end of the first actuator, the first actuator configured to move the first debris hopper from the stowed position to a deployed position in front of and above the chassis; wherein the controller is coupled to the first actuator to control operation of the lift system. Especially, the lift system may further comprise a position sensor 166A to determine an orientation of the first debris hopper about the hopper axis.

Specifically, the first debris hopper may comprise: a first end wall; a second end wall spaced from the first end wall along the hopper axis; a hopper wall extending between the first end wall and the second end wall to define a debris space; and an access opening extending between the first end wall and the second end wall.

More specifically, the controller may be configured to operate the motor to oscillate the first debris hopper on the hopper axis in the stowed position to move debris into the debris space with the access opening tilted toward the brush. Especially, the controller may be configured to operate the motor to oscillate the first debris hopper on the hopper axis in the stowed position to move debris into the debris space with the access opening tilted upward. Especially, the lift system may further comprise an inclination sensor to sense an inclination of the chassis, wherein the controller is configured to operate the motor to rotate the first debris hopper on the hopper axis in response to output of the inclination sensor.

Specifically, the controller may be configured to operate the motor to rotate the first debris hopper to maintain the access opening at a top of the first debris hopper. Especially, the first debris hopper may further comprise a drain opening in the hopper wall opposite the access opening. Specifically, the controller may be configured to operate the motor to rotate the first debris hopper to maintain the drain opening at a bottom of the first debris hopper. Especially, the controller may be configured to operate the motor to rotate the first debris hopper to position the access opening at a bottom of the first debris hopper and to oscillate the first debris hopper while the access opening is positioned at the bottom. Especially, the controller may be configured to operate the motor to rotate the first debris hopper to position the access opening relative to the brush depending on a diameter of the brush. Especially, the controller may be configured to operate the motor to rotate the first debris hopper on the hopper axis as the first actuator moves the first debris hopper to maintain the access opening in an upward orientation. Especially, the controller may be configured to operate the motor to rotate the first debris hopper on the hopper axis to position the access opening in an upward orientation during a transportation operation wherein the brush is not rotating and the propulsion system is operating.

In some embodiments, the floor cleaning machine of any of the preceding claims, further comprises: a scrubbing system disposed on the chassis, the scrubbing system comprising: a cleaning fluid tank; a distribution system for receiving and dispensing cleaning fluid from the fluid tank to the brush; a recovery system for capturing cleaning fluid from behind the brush; and a recovery container for receiving cleaning fluid from the recovery system.

In a second aspect, the disclosure provides a method for cleaning a floor comprising providing the floor cleaning machine according to the first aspect, operating the floor cleaning machine to clean an area of the floor, and operating the floor cleaning machine to empty the first debris hopper into an associated refuse container.

The individual first and second aspects of the present disclosure may each be combined with any of the other aspects. These and other aspects of the disclosure will be apparent from the following description with reference to the described embodiments.

Figure 2:
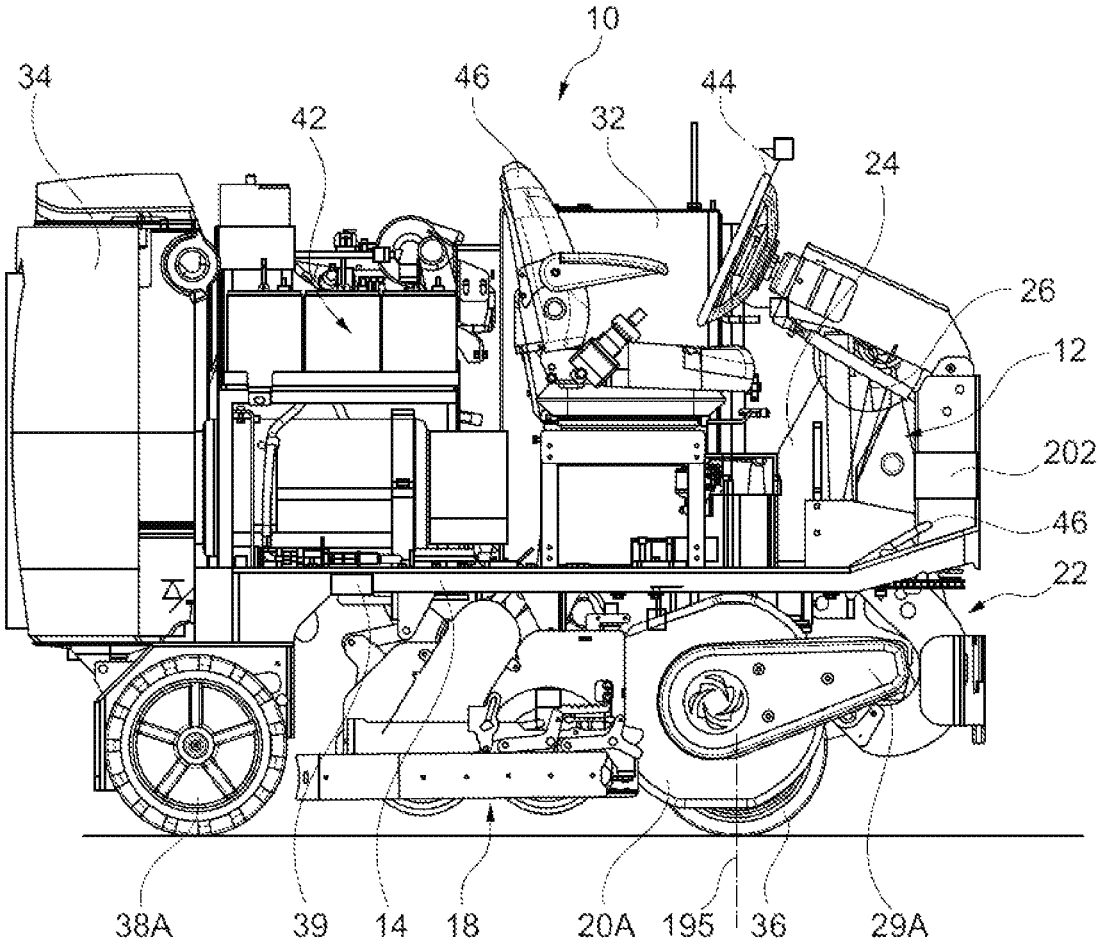
FIG. 2 is a side view of the floor cleaning machine of FIG. 1 showing the high dump hopper system in a stowed configuration.
Figure 3:
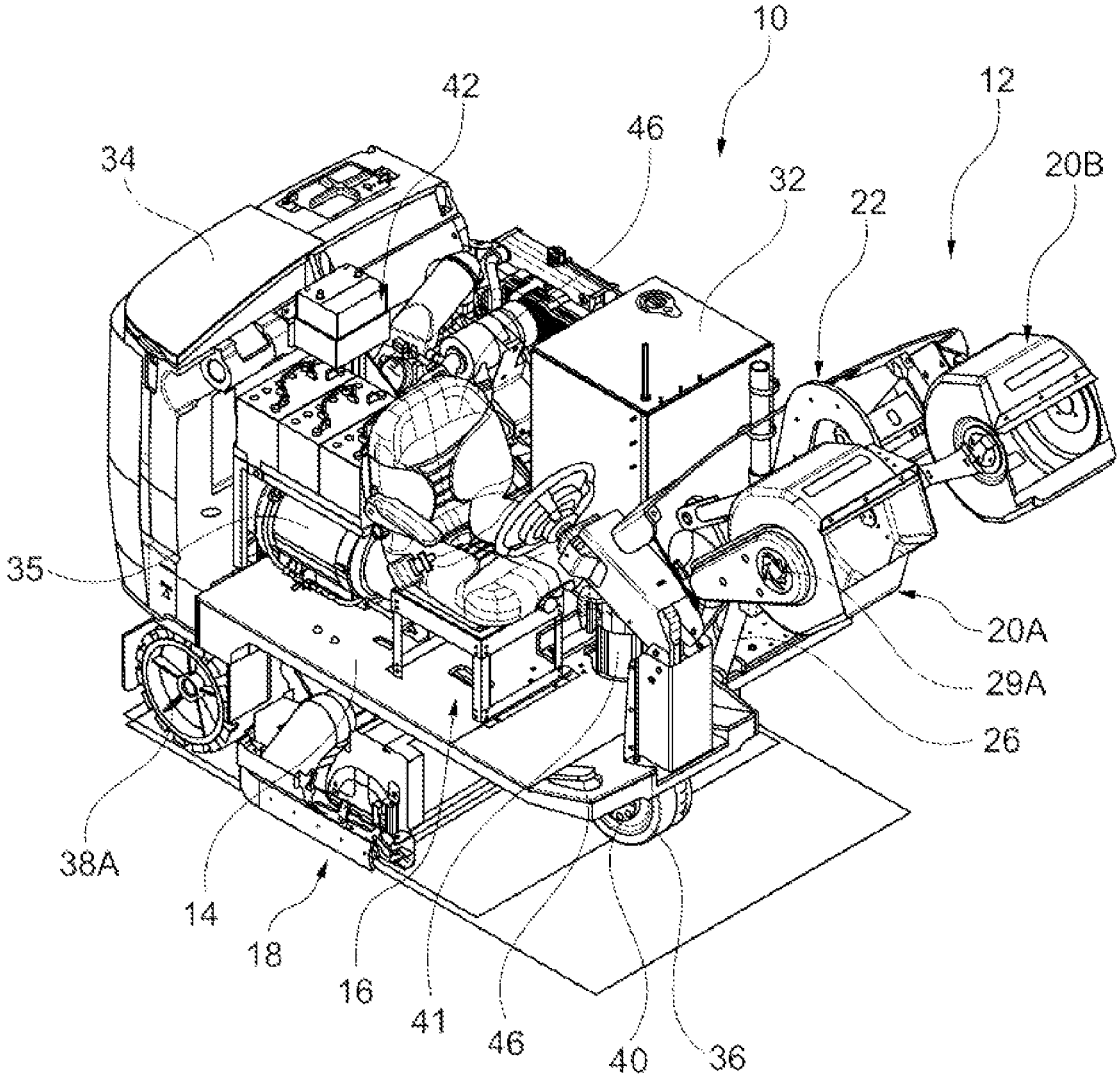
FIG. 3 is a perspective view of the floor cleaning machine of FIG. 1 showing first and second debris hoppers of the high dump hopper system in an extended configuration.
Figure 4:
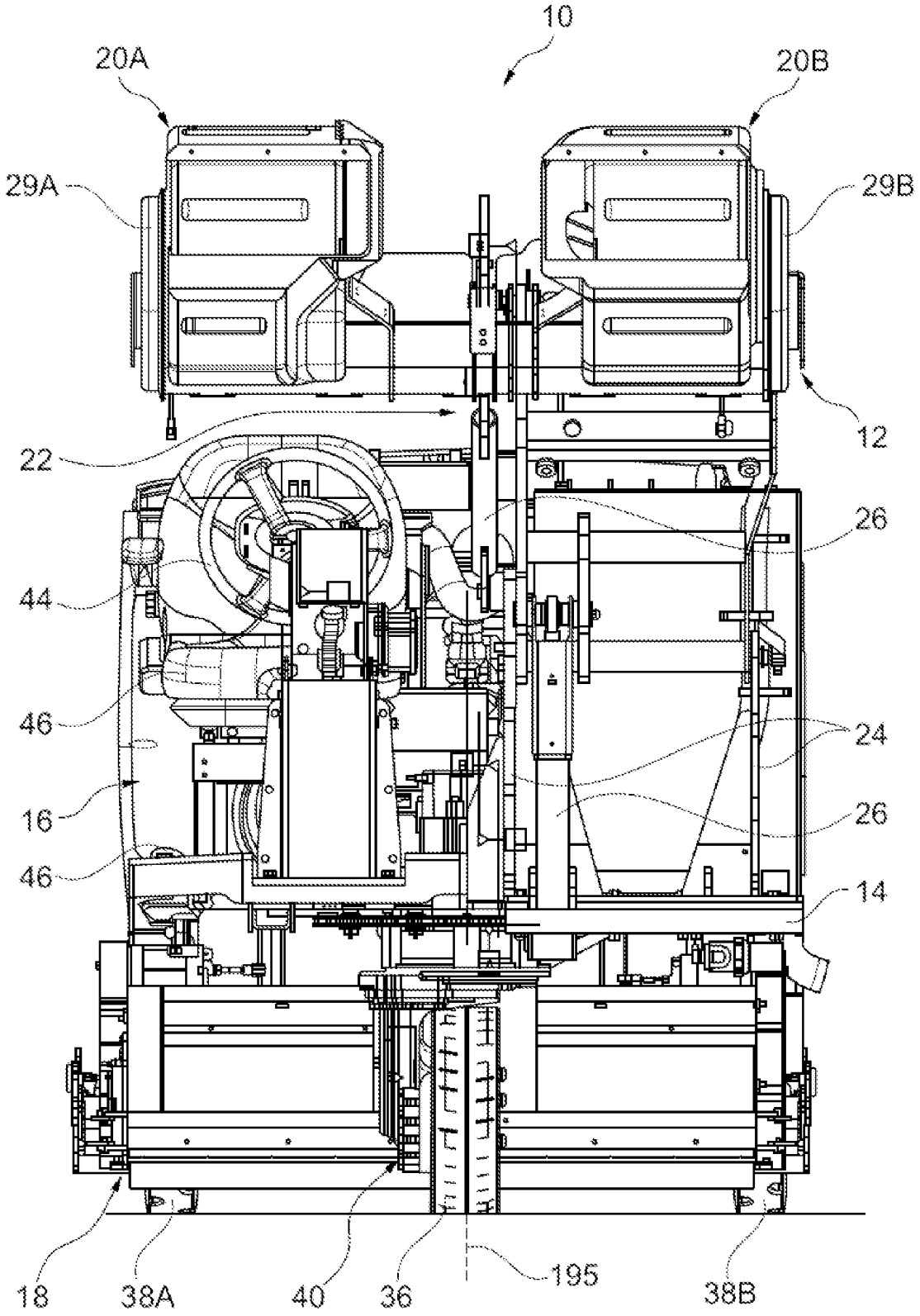
FIG. 4 is a front view of the floor cleaning machine of FIG. 3 showing the first and second debris hoppers positioned above an operator station.

FIG. 1 is a perspective view of floor cleaning machine 10 including high dump hopper system 12. FIG. 2 is a side view of floor cleaning machine 10 of FIG. 1 showing high dump hopper system 12 in a stowed configuration. FIG. 3 is a perspective view of floor cleaning machine 10 of FIG. 1 showing high dump hopper system 12 in an extended configuration. FIG. 4 is a front view of floor cleaning machine 10 of FIG. 3 showing first debris hopper 20A and second debris hopper 20B positioned above operator station 16. FIGS. 1-4 are discussed concurrently unless specifically noted otherwise.

Floor cleaning machine 10 can comprise chassis 14, operator station 16, and scrubber assembly 18. High dump hopper system 12 can comprise first debris hopper 20A and second debris hopper 20B, linkage system 22, frame 24 and actuator 26.

High dump hopper system 12 can be mounted to chassis 14, such as on a top side of chassis 14. Operator station 16 can additionally be located on a top side of chassis 14. Operator station 16 and high dump hopper system 12 can both be located at or near a front end of chassis 14, with frame 24 being located to one side and operator station 16 being located to the opposite side. As such, an operator can have good visibility for operating floor cleaning machine 10 and high dump hopper system 12 can have access to the front of floor cleaning machine 10 for movement of first debris hopper 20A and second debris hopper 20B without increasing the length of the machine.

As can be seen in FIGS. 1 and 2, first debris hopper 20A and second debris hopper 20B can be stowed under chassis 14, just ahead of scrubber assembly 18. Scrubber assembly 18 can comprise first scrubber brush 28A and second scrubber brush 28B. The first scrubber brush 28A and second scrubber brush 28B can rotate about respective brush axis 190 and brush axis 191 (see e.g., FIGS. 5 and 17), here shown as parallel brush axis 190 and brush axis 191. First scrubber brush 28A and second scrubber brush 28B can be configured to direct or push debris into first debris hopper 20A and second debris hopper 20B when first debris hopper 20A and second debris hopper 20B are in or near the stowed position. Linkage system 22 of high dump hopper system 12 can be configured to hold first debris hopper 20A and second debris hopper 20B in place via actuator 26 until an emptying operation is ready to be executed.

As can be seen in FIGS. 3 and 4, first debris hopper 20A and second debris hopper 20B can be extended out in front of chassis 14, above operator station 16. High dump hopper system 12 can comprise drive system 29A and drive system 29B for rotating first debris hopper 20A and second debris hopper 20B. First debris hopper 20A and second debris hopper 20B can be rotated relative to linkage system 22 to control the position of opening 30A and opening 30B. For example, opening 30A and opening 30B can be maintained in an upper location during transition from the stowed position of FIGS. 1 and 2 to the extended position of FIGS. 3 and 4 to prevent or inhibit debris from falling out of first debris hopper 20A and second debris hopper 20B. However, once in the extended position, first debris hopper 20A and second debris hopper 20B can be rotated such that opening 30A and opening 30B face downward so that debris within first debris hopper 20A and second debris hopper 20B can be dumped or emptied from high dump hopper system 12.

Floor cleaning machine 10 can be configured to perform various floor cleaning operations. As mentioned, scrubber assembly 18 can be used to collect debris from a floor surface. Floor cleaning machine 10 can additionally be configured as a scrubbing system wherein cleaning liquid from tank 32 is dispensed onto the floor surface and a recovery system can be used to collect dirty cleaning liquid for storage in recovery tank 34. As such, floor cleaning machine can be configured to include various solution dispensers, scrubbing brushes, suction systems and squeegees to facilitate scrubbing. For example, floor cleaning machine 10 can include a pump (not visible in FIG. 1) for dispensing liquid from tank 32 and providing recovery suction to return dirty liquid to recovery tank 34. An example sweeper-scrubber machine is described in Pub. No. US 2018/0360284 to Borra et al., entitled "Floor Scrubber Machine with Enhanced Steering and Solution Flow Functionality," the contents of which are incorporated herein by this reference in their entirety. In an example, high dump hopper system 12 of the present disclosure can be incorporated into the floor scrubber machine disclosed in Pub. No. US 2018/0360284. Although the figures of the present disclosure are described with reference to combined scrubber-sweeper wherein a common set of roller bristles provide scrubbing and sweeping action, the present disclosure is applicable to other types of sweepers such as those that only provide sweeping action.

Floor cleaning machine 10 can be configured to traverse the floor surface using forward steered wheel 36 and rear wheel 38A and rear wheel 38B. Inclination sensor 39 can be attached to chassis 14 or another location on floor cleaning machine 10 to determine an orientation of floor cleaning machine 10 relative to horizontal. In an example, rear wheel 38A and rear wheel 38B can be mounted to freely rotate on rear axis 182 (see e.g., FIG. 18) that can be provided by one or two axles connected to chassis 14. Forward steered wheel 36 can be coupled to drive mechanism 40 (see e.g., FIGS. 3 and 4) that can receive power from batteries 42 for rotation about forward axis 180 (see e.g., FIG. 18). However, in other examples, floor cleaning machine 10 can receive power from one or more power sources 43 including from a battery, a hydraulic system, a genset, an internal combustion engine, a fuel cell, a hybrid-battery system and any other system known in the art. In the illustrated example, floor cleaning machine 10 can use electric power from batteries 42 or mechanical power from an engine configured to combust fuel from tank 35, such as liquid propane. Steering wheel 44 can be controlled by an operator located in operator station 16 to turn forward steered wheel 36 around a steering axis 195 (see e.g., FIGS. 2 and 4) to thereby provide steering. A steering motor 41 (see e.g., FIG. 3) can be used for turning the forward steered wheel 36 around the steering axis 195. For example, an operator can sit in chair 45 to engage steering wheel 44 and pedal 46 to operate floor cleaning machine 10. Separate controls, such as buttons or lift control 204 and hopper control 206 (see e.g., FIG. 19), for high dump hopper system 12 can be provided proximate operator station 16 to allow the operator to move first debris hopper 20A and second debris hopper 20B between the stowed and extended positions and to control the orientation of first debris hopper 20A and second debris hopper 20B. Such controls can be located proximate operator station 16. Furthermore, operation of floor cleaning machine 10 and components and sub-systems thereof can be coordinated by controller 202, which is described in greater detail with reference to FIG. 19. Additionally, controller 202 can be connected to inclination sensor 39.

Figure 5:
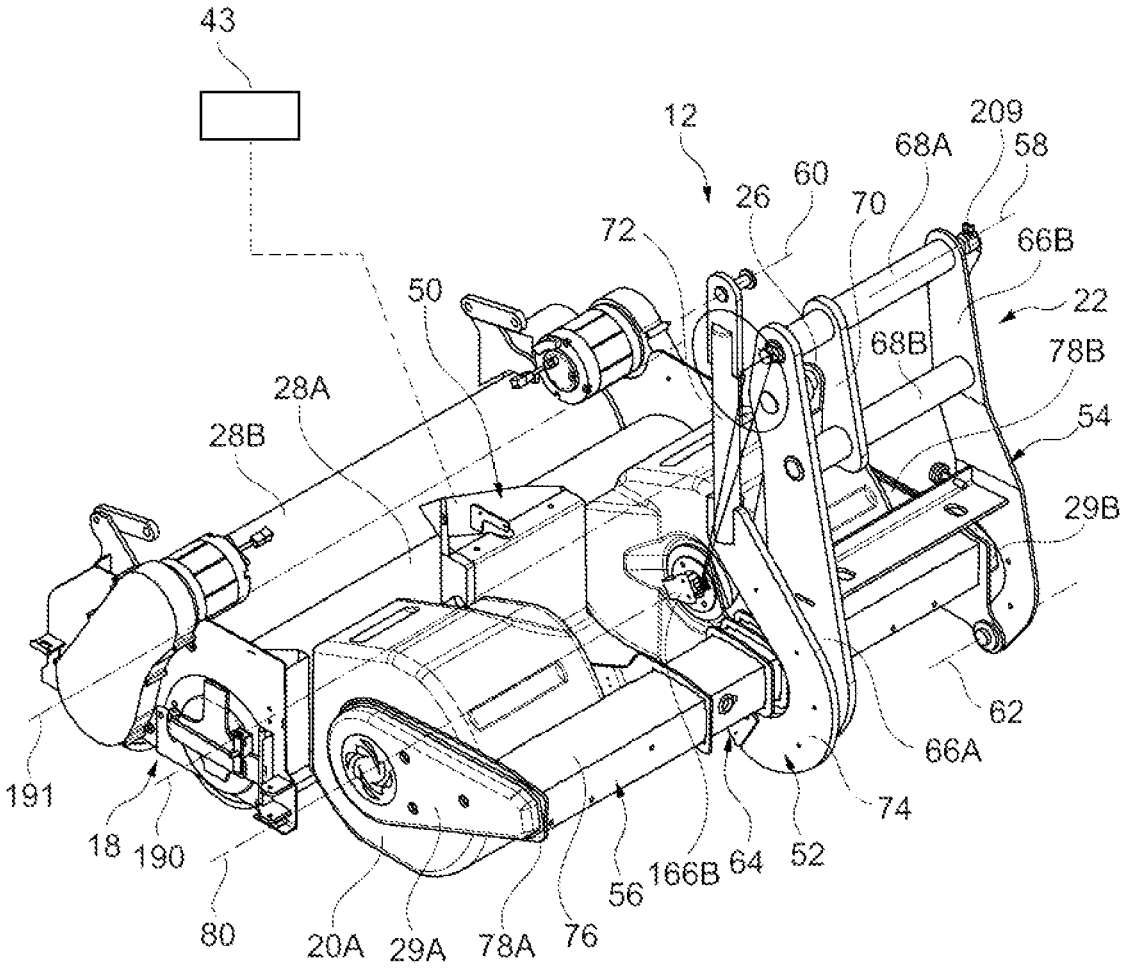
FIG. 5 is a perspective view of the high dump hopper system of FIGS. 1-4.

FIG. 5 is a perspective view of high dump hopper system 12 of FIGS. 1-4 disposed next to scrubber assembly 18. High dump hopper system 12 can comprise first debris hopper 20A, second debris hopper 20B, linkage system 22, frame 24 (see e.g., FIGS. 7-10), actuator 26 (see e.g., FIG. 4) and drive system 29A and drive system 29B, as mentioned. High dump hopper system 12 can also comprise splitter 50 that is disposed to prevent debris from passing between first debris hopper 20A and second debris hopper 20B and guide such debris into first debris hopper 20A and second debris hopper 20B, as is discussed in greater detail below with reference to FIGS. 15 and 17.

Linkage system 22 can comprise follower link 52, lift link 54 and hopper link 56. Lift link 54 can be mounted to frame 24 (see e.g., FIG. 5) to rotate about lift link upper axis 58. Follower link 52 can be mounted to frame 24 to rotate about follower link upper axis 60. Follower link upper axis 60 can be above and behind lift link upper axis 58. Lift link 54 can couple to hopper link 56 at pivot axis 62 in front of hopper link 56. Follower link 52 can couple to hopper link 56 at follower link lower axis 64 below hopper link 56. As such, lift link 54 can rotate about lift link upper axis 58 to pull hopper link 56, while hopper link 56 pivots about pivot axis 62 relative to lift link 54. Follower link 52 and lift link 54, specifically the relative locations of the lift link upper axis 58 and the follower link upper axis 60 and pivot axis 62 and follower link lower axis 64, respectively, can facilitate linkage system 22 pulling first debris hopper 20A and second debris hopper 20B along a horizontal and longitudinal, e.g., outward and upward, movement path, as is discussed with reference to FIGS. 9-13.

Lift link 54 can comprise first link 66A and second link 66B that can couple to hopper link 56 at spaced apart locations to provide support for hopper link 56. First link 66A and second link 66B can be coupled by crosslink 68A and crosslink 68B for stability. Additionally, crosslink 68A and crosslink 68B can be connected by drive plate 70 to which actuator 26 can be connected. Drive plate 70 and crosslink 68A and crosslink 68B can facilitate torque transfer from actuator 26 to lift link 54. Lift link 54 can provide the main lifting force to hopper link 56 via actuator 26. Thus, lift link 54 can pull hopper link 56 via couplings at pivot axis 62. As will be discussed with reference to FIG. 9, lift link 54 can be configured to pull hopper link 56 forward and upward, out from under chassis 14.

Follower link 52 can comprise extension portion 72 and hook portion 74. Follower link 52 can be configured to be driven by movement of lift link 54. Thus, as actuator 26 pushes lift link 54 upwards, follower link 52 will be additionally lifted upward. However, as will be discussed with reference to FIGS. 10-12, due to the locations of lift link upper axis 58 and follower link upper axis 60 and pivot axis 62 and follower link lower axis 64, follower link 52 rotates hopper link 56 as lift link 54 lifts hopper link 56.

Hopper link 56 can comprise crossmember 76, side plate 78A and side plate 78B and various other brackets for coupling to first debris hopper 20A and second debris hopper 20B and lift link 54. First debris hopper 20A and second debris hopper 20B can be configured to pivot relative to crossmember 76 on hopper axis 80. Crossmember 76 can provide a laterally extending structure for coupling first debris hopper 20A and second debris hopper 20B together for engaging scrubber assembly 18. Side plate 78A and side plate 78B can provide structures for displacing first debris hopper 20A and second debris hopper 20B further underneath chassis 14 and mounting locations for drive system 29A and drive system 29B.

As will be discussed herein, operation of actuator 26 and drive system 29A and drive system 29B can be controlled by controller 202 (see e.g., FIG. 19) to execute pre-programmed instructions to move hoppers through specific operations, such as high dump, tip-and-shake, tip-for-grade, tip-for-transport, dump-and-shake, tip-to-drain, tip-for-brush-wear and the like.

Figure 6:
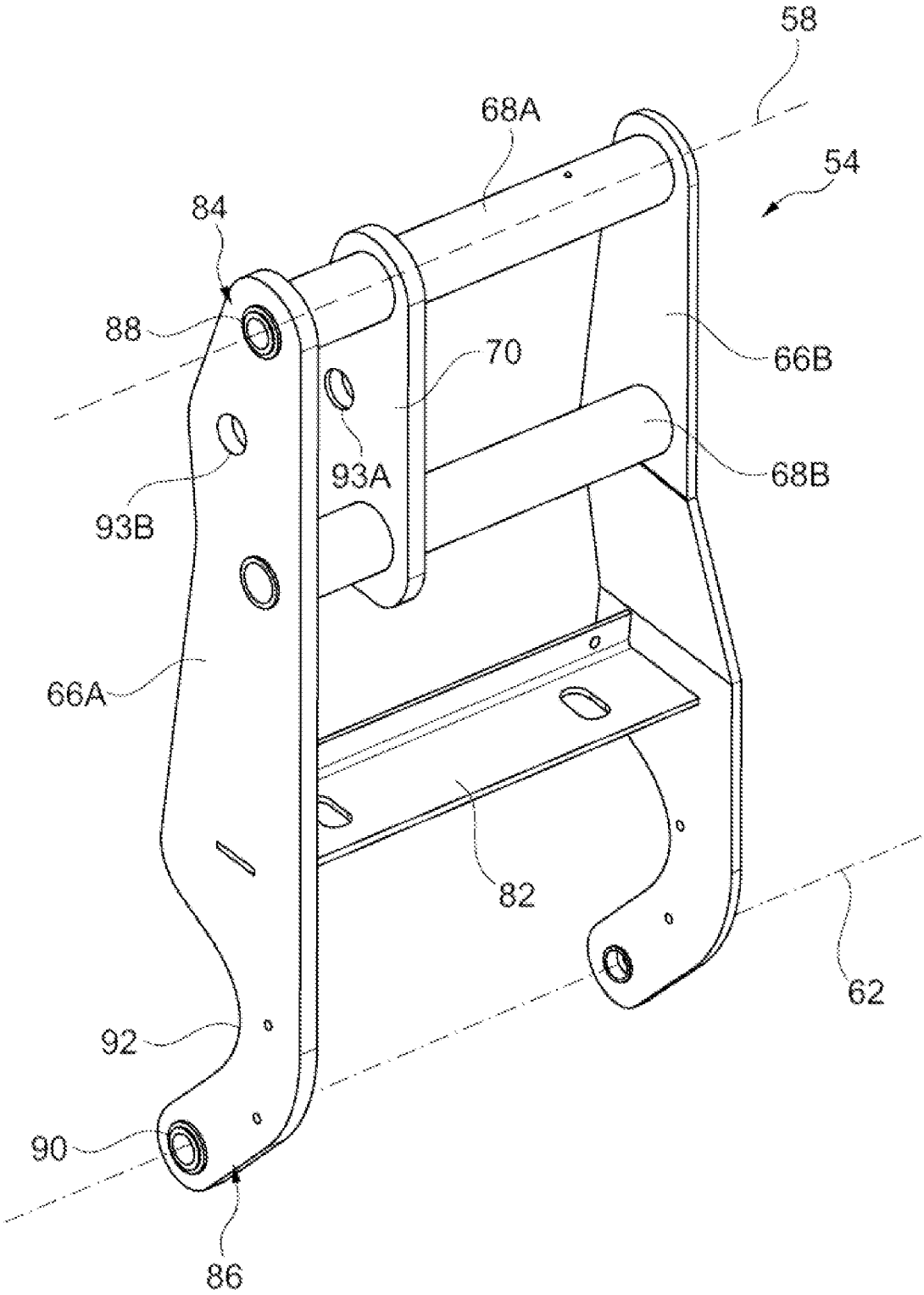
FIG. 6 is a perspective view of a lift link for a lift system for the high dump hopper system of FIGS. 1-5.

FIG. 6 is a perspective view of lift link 54 for high dump hopper system 12 of FIGS. 1-5. Lift link 54 can comprise first link 66A, second link 66B, crosslink 68A and crosslink 68B, drive plate 70 and mounting plate 82. Mounting plate 82 can provide additional stabilization for first link 66A and second link 66B and can provide a platform for coupling other components to high dump hopper system 12, such as pumps, motors, hoses, wiring and the like.

First link 66A can comprise pivot end 84 and hopper end 86. Pivot end 84 can include bore 88 for joining with crosslink 68A. A fastener can be inserted into bore 88 to pivotably couple lift link 54 to frame 24. Pivot end 84 can be coupled to crosslink 68B in any suitable manner. Hopper end 86 can comprise bore 90 for pivotably coupling with hopper link 56. Bore 90 can define pivot axis 62. Hopper end 86 can comprise a curved or hockey stick shape formed by cutout 92. Cutout 92 can allow bore 90 to be placed in front of and/or underneath hopper link 56. Second link 66B can be configured similarly as first link 66A.

Drive plate can include bore 93A and first link 66A can include bore 93B. Bores 93A and 93B can be used to couple to actuator 26. In an example, actuator 26 can comprise a hydraulic cylinder configured to extend and retract using pressurized hydraulic fluid or electrical activation. Thus, a pin can be extended through an eyelet of a hydraulic piston and bores 93A and 93B. Floor cleaning machine 10 can be provided with a hydraulic system.

Figure 7:
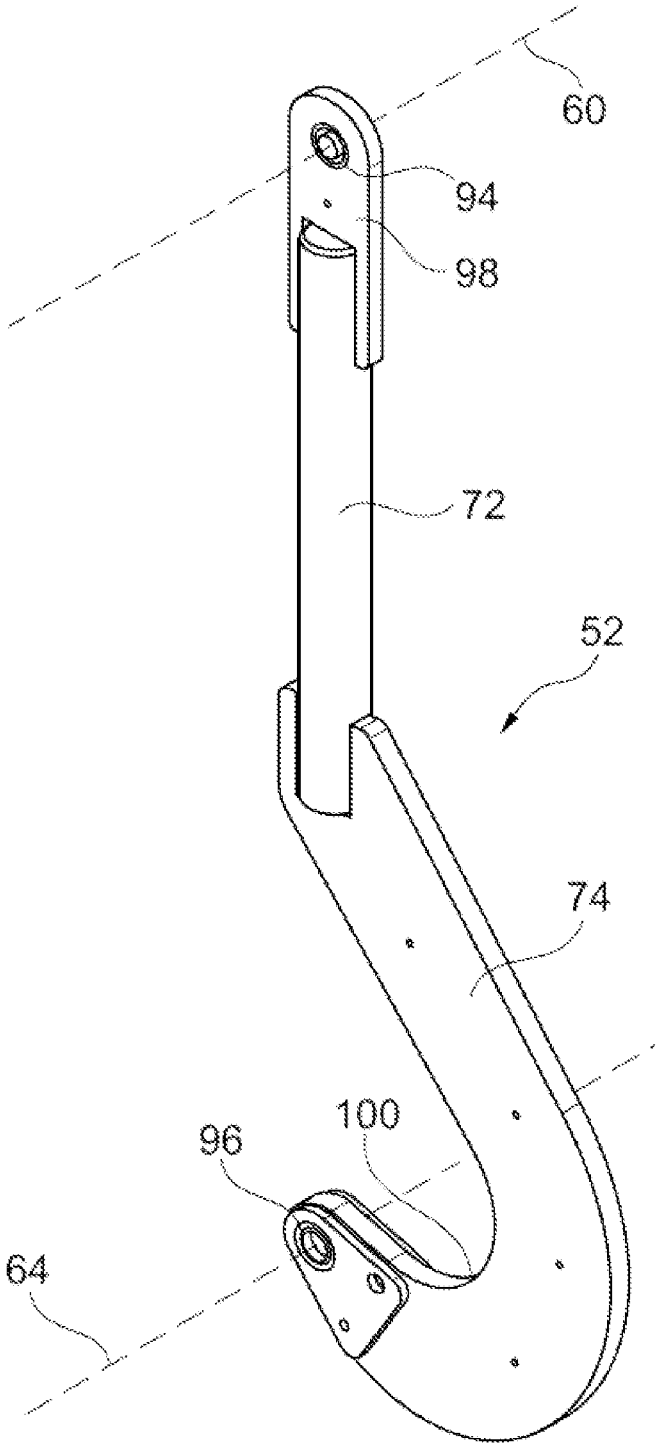
FIG. 7 is a perspective view of a follower link for a lift system for the high dump hopper system of FIGS. 1-5.

FIG. 7 is a perspective view of follower link 52 for high dump hopper system 12 of FIGS. 1-5. Follower link 52 can comprise extension portion 72, hook portion 74, first eyelet 94 and second eyelet 96. First eyelet 94 can be located in plate 98 and can comprise a bore therethrough. Extension portion 72 can comprise an elongate member that connects first eyelet 94 and hook portion 74. First eyelet 94 can define follower link upper axis 60. Hook portion 74 can comprise a curved or fish-hook shaped that forms recess 100. Recess 100 can allow second eyelet 96 to be placed underneath hopper link 56. Recess 100 can be deeper than cutout 92 of lift link 54 to allow second eyelet 96 to be positioned further underneath and further backward relative to hopper link 56 than lift link 54 to produce offset between pivot axis 62 and follower link lower axis 64 to enable the rotation of hopper link 56. Second eyelet 96 can be formed by a bore through a distal portion of hook portion 74. Second eyelet 96 can define follower link lower axis 64.

Figure 8:
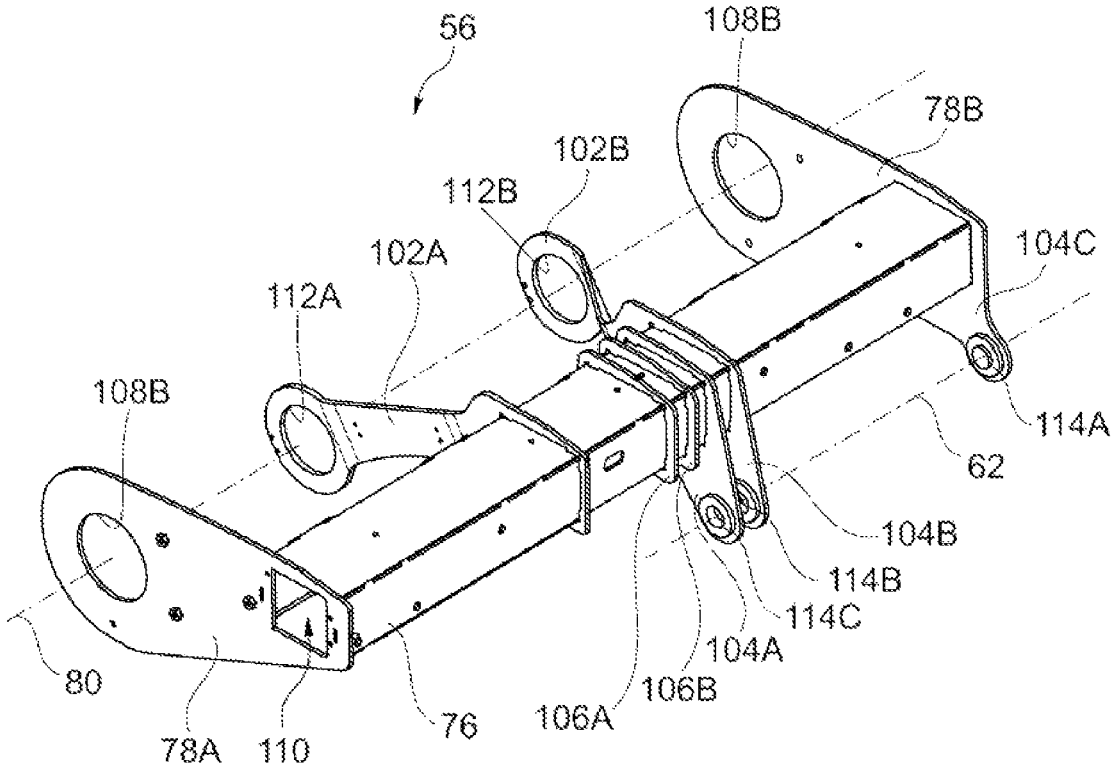
FIG. 8 is a perspective view of a hopper link for a lift system for the high dump hopper system of FIGS. 1-5.

FIG. 8 is a perspective view of hopper link 56 for high dump hopper system 12 of FIGS. 1-5. Hopper link 56 can comprise crossmember 76, side plate 78A and side plate 78B, first hopper bracket 102A, second hopper bracket 102B, first drive flange 104A, second drive flange 104B, third drive flange 104C and follower flanges 106A and 106B.

Crossmember 76 can comprise a tubular member for mounting first debris hopper 20A and second debris hopper 20B and drive system 29A and drive system 29B to high dump hopper system 12. Crossmember 76 can include internal space 110 for mounting components of high dump hopper system 12, such as motor 160A and motor 160B for drive system 29A and drive system 29B. Side plate 78A and side plate 78B can comprise flat bodies for supporting drive system 29A and drive system 29B, respectively. Side plate 78A and side plate 78B can include bores 108A and 108B, which can be centered on hopper axis 80.

First hopper bracket 102A and second hopper bracket 102B can also include bores 112A and 112B, respectively, that can be centered on hopper axis 80. First debris hopper 20A can be connected to side plate 78A and first hopper bracket 102A and second debris hopper 20B can be connected to side plate 78B and second hopper bracket 102B.

Side plate 78B can include bore 114A, second drive flange 104B can include bore 114B and first drive flange 104A can include bore 114C. Bores 114A —114C can be centered on pivot axis 62. Bore 114A can be pivotably connected to second link 66B, and bores 114B and 114C can be pivotably connected to first link 66A. Follower flanges 106A and 106B can additionally include bores (not visible in FIG. 8) for pivotably connecting to follower link 52 at second eyelet 96.

Figure 9:
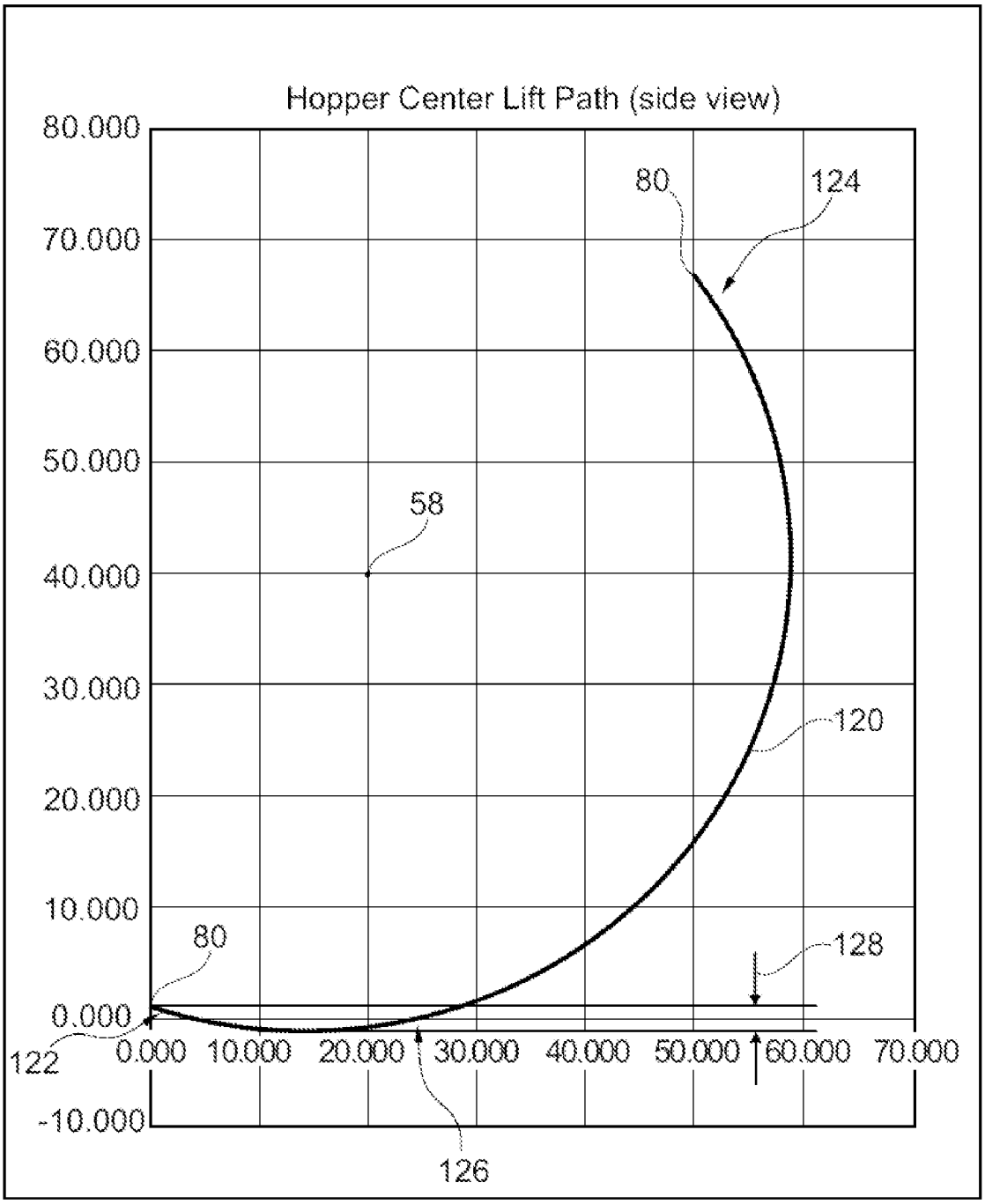
FIG. 9 is a graph showing a lift path for the first and second debris hoppers of FIGS. 1-5 between the stowed position of FIG. 2 and the extended position of FIG. 3.

FIG. 9 is a graph showing lift path 120 for first debris hopper 20A and second debris hopper 20B of FIG. 5. FIG. 9 shows a side view of the centers of first debris hopper 20A and second debris hopper 20B on hopper axis 80 moving along lift path 120 or trajectory. Lift link upper axis 58 of lift link 54 is shown for reference. First debris hopper 20A and second debris hopper 20B extend from stowed position 122 to extended position 124. In stowed position 122, hopper axis 80 is located underneath chassis 14 (see e.g., FIG. 1). Lift link 54 moves first debris hopper 20A and second debris hopper 20B under chassis 14 over an elongate nearly horizontal path to point 126 within height band 128 where minimal longitudinal movement of first debris hopper 20A and second debris hopper 20B occurs. However, once hopper axis 80 moves beyond point 126 where first debris hopper 20A and second debris hopper 20B are clear of chassis 14, lift path 120 undergoes a more arcuate path or trajectory that extends longitudinally up to extended position 124. As such, first debris hopper 20A and second debris hopper 20B can be moved to an elevated position for maneuvering over a refuse container.

Thus, lift path 120 or trajectory comprises a spiral shape that comprises a curve with a changing radius of curvature, which in the illustrated embodiment the radius slowly decreases at the beginning of movement from stowed position 122 and then rapidly increases as it moves closer to the extended position 124. As such, the smaller radius of curvature that grows faster allows first debris hopper 20A and second debris hopper 20B to stay within narrow height band 128 in the beginning, but thereafter is free to elevate once the structure of chassis 14 is cleared. The shape of lift path 120 or trajectory is influenced by operation of follower link 52 on hopper link 56. Movement of first debris hopper 20A and second debris hopper 20B across lift path 120 or trajectory, as well as the relative movement between follower link 52 and hopper link 56, are shown in FIGS. 10-13. In additional examples, other lift paths or trajectories can be used to provide lateral and upward movement as described herein, including those that are similar to lift path 120 or trajectory and other compound, single or changing radius lift paths or trajectories that are different.

Figure 20:
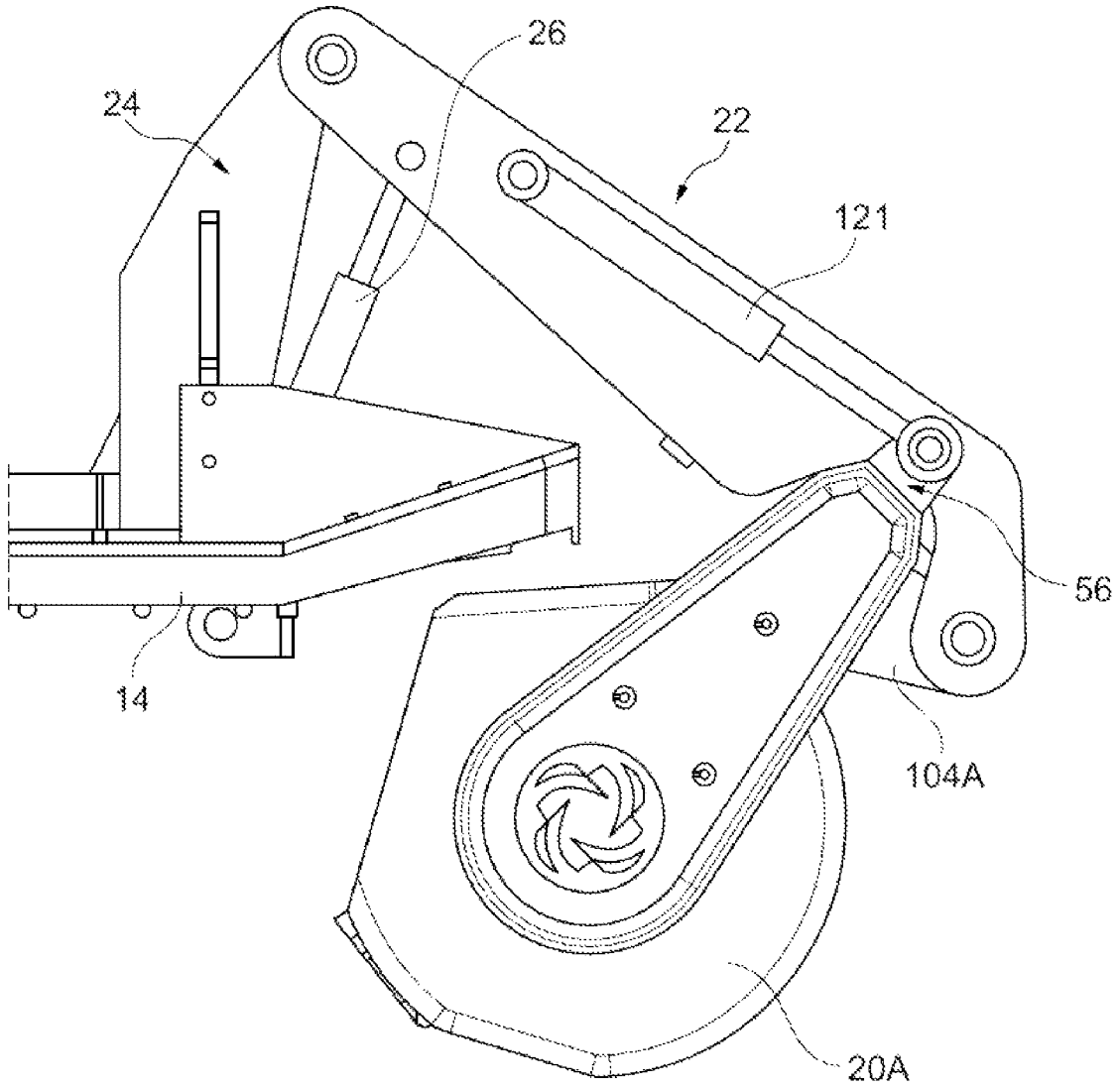
FIG. 20 is a side schematic view of another example of a lift system for a high dump hopper system of the present disclosure utilizing compound actuators.

FIG. 20 shows another example of high dump hopper system 12 that can be configured with two actuators, actuators 26 and 121, to achieve lift paths suitable for pulling first debris hopper 20A and second debris hopper 20B out from under chassis 14 and then upward, such as lift path 120. In such examples, follower link 52 can be eliminated and lift link 54 and hopper link 56 can be connected by a second actuator. The second actuator can change the angle between lift link 54 and hopper link 56 as the first actuator, actuator 26, lifts hopper link 56. A similar result as is discussed in the previous paragraph can be achieved where the radius between lift link upper axis 58 and hopper link 56 can be increased initially while hopper link 56 is underneath chassis 14 to produce a generally or more horizontal movement of hopper link 56 before enabling a more longitudinal movement.

FIGS. 10-13 are side views of high dump hopper system 12 of FIG. 5 showing first debris hopper 20A and second debris hopper 20B moving between stowed position 122 (see e.g., FIG. 9) and extended position 124 (see e.g., FIG. 9). Angle θ is shown between follower link 52 and hopper link 56. Lift link upper axis 58 and follower link upper axis 60 of lift link 54 and follower link 52, respectively, are shown relative to frame 24. As mentioned, FIGS. 10-13 illustrate an example of lift path 120 with reference to specific angles. However, angle θ can be varied to achieve the same or a similar range of motion.

Figure 10:
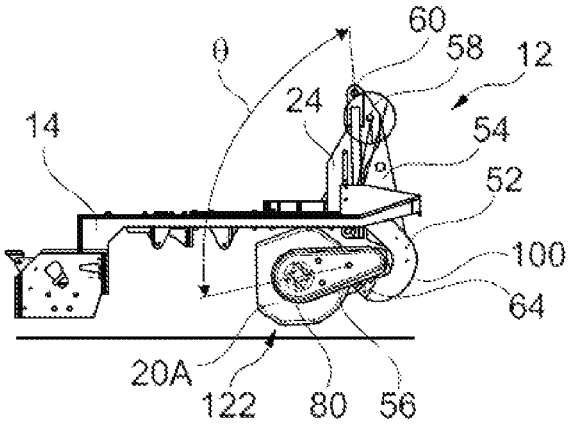
FIGS. 10-13 are side views of the high dump hopper system of FIG. 5 showing the first and second debris hoppers moving between the stowed position and the extended position.

As can be seen in FIG. 10, first debris hopper 20A and second debris hopper 20B are underneath chassis 14 in the stowed position. Side plate 78A is shown positioned within recess 100 of follower link 52. Angle θ is shown to be slightly greater than ninety degrees.

Figure 11:
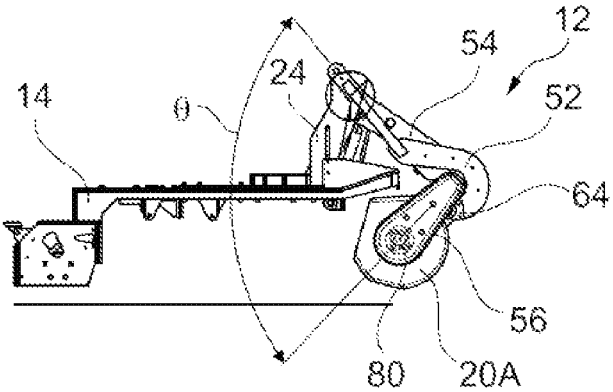

As can be seen in FIG. 11, lift link 54 pulls hopper link 56 underneath chassis 14 in a generally horizontal direction underneath chassis 14. The horizontal movement of first debris hopper 20A and second debris hopper 20B is due to hopper axis 80 of hoppers being behind lift link upper axis 58 of lift link 54 and follower link 52 increasing the radius between the lift link upper axis 58 and hopper axis 80 as hook portion 74 of follower link 52 pivots hopper link 56 about follower link lower axis 64. In FIG. 11, angle θ is shown to be approximately ninety degrees.

Figure 12:
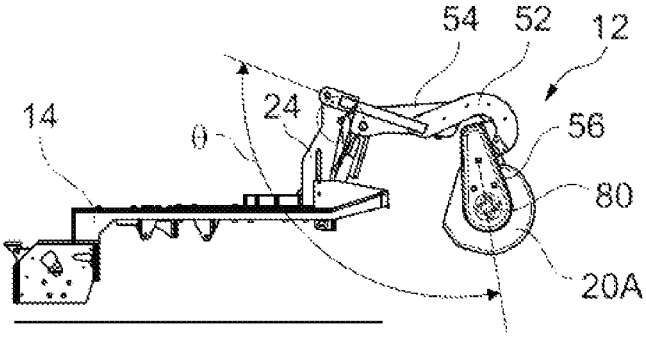

As can be seen in FIG. 12, lift link 54 continues to pull hopper link 56 along while rotating at lift link upper axis 58, and hook portion 74 continues to rotate side plate 78A and side plate 78B at follower link upper axis 60 away from follower link 52 such that angle θ increases. As such, first debris hopper 20A and second debris hopper 20B begin a much more substantial longitudinal movement from FIG. 11 to FIG. 12 as compared to the movement from FIG. 10 to FIG. 11. In FIG. 12, angle θ is shown to be greater than ninety degrees.

Figure 13:
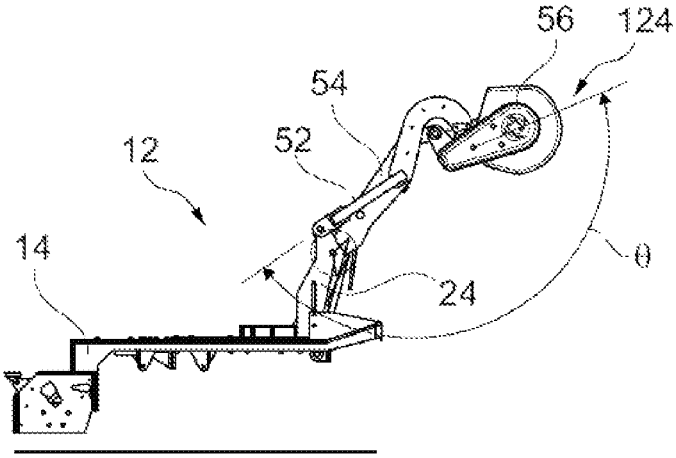

As can be seen in FIG. 13, lift link 54 moves hopper link 56 to a fully lifted position of extended position 124. Follower link additionally moves hopper link 56 to a fully rotated position. As such, hopper axis 80 of first debris hopper 20A and second debris hopper 20B is positioned at its maximum distance from lift link upper axis 58 and is extended forward of and above chassis 14. In FIG. 13, angle θ is shown to be almost one-hundred-eighty degrees.

Figure 14:
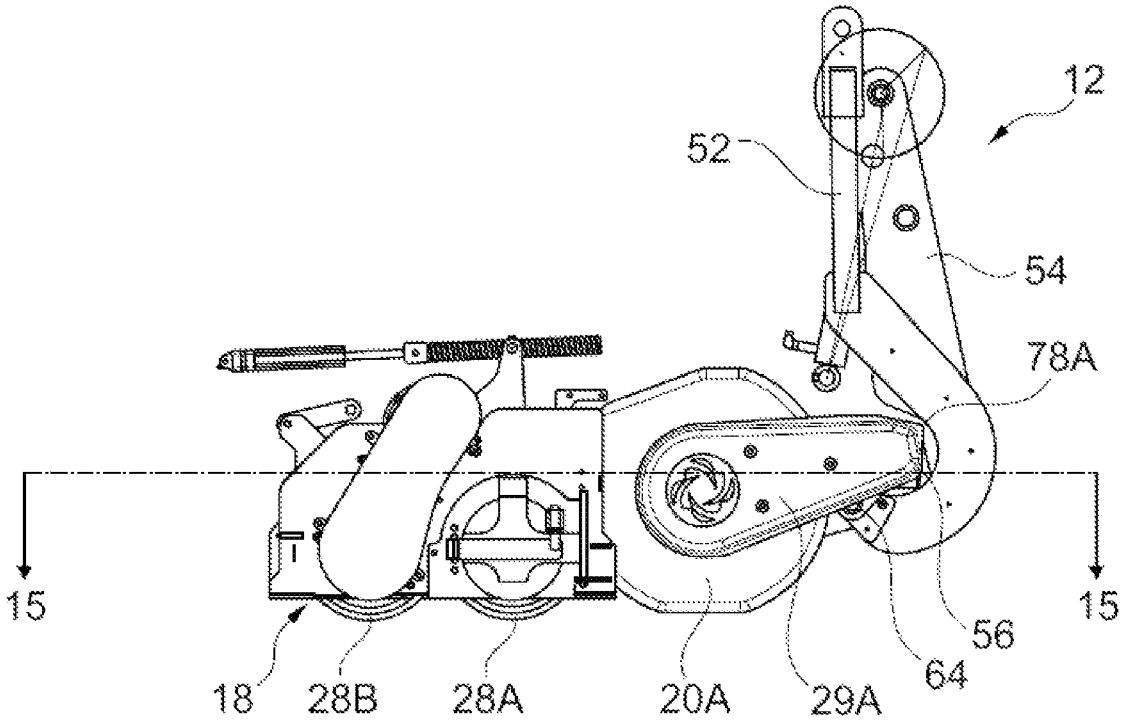
FIG. 14 is a side view of the high dump hopper system of FIG. 5.
Figure 15:
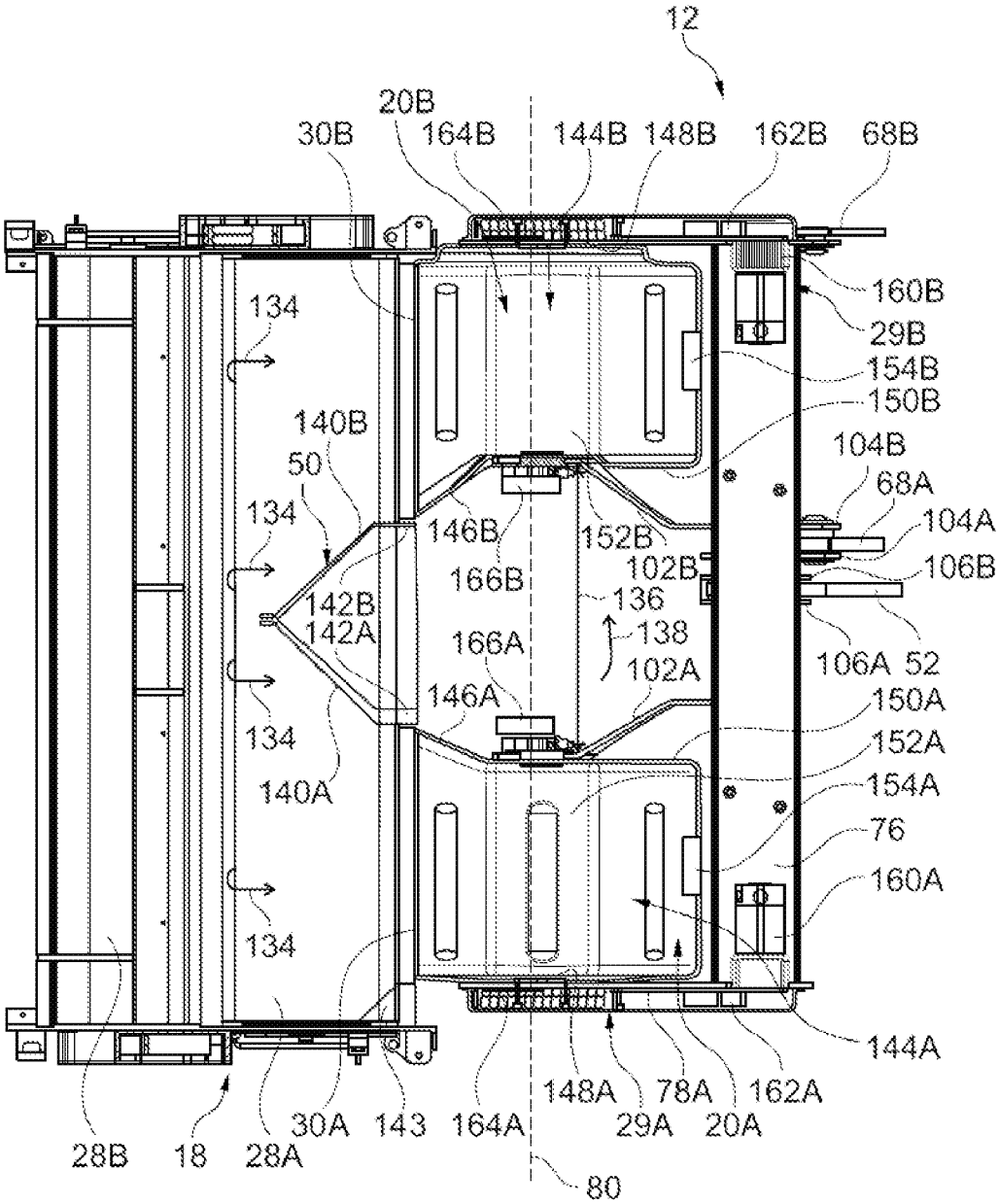
FIG. 15 is a top cross-sectional view of the high dump hopper system of FIG. 14 showing a splitter located between the first and second debris hoppers.

FIG. 14 is a side view of high dump hopper system 12 of FIG. 5. FIG. 15 is a top cross-sectional view of high dump hopper system 12 of FIG. 14 showing splitter 50 located between first debris hopper 20A and second debris hopper 20B. FIGS. 13 and 14 are discussed concurrently.

High dump hopper system 12 can be mounted to chassis 14 (see e.g., FIG. 1) to engage scrubber assembly 18, which can comprise first scrubber brush 28A and second scrubber brush 28B. High dump hopper system 12 can comprise follower link 52, lift link 54 and hopper link 56. Side plate 78A and first hopper bracket 102A can couple first debris hopper 20A to hopper link 56 and side plate 78B and second hopper bracket 102B can couple second debris hopper 20B to hopper link 56. First debris hopper 20A and second debris hopper 20B can be mounted in any suitable rotatable fashion, such as by using bushings, bearings, pinned connections and the like.

Figure 17:
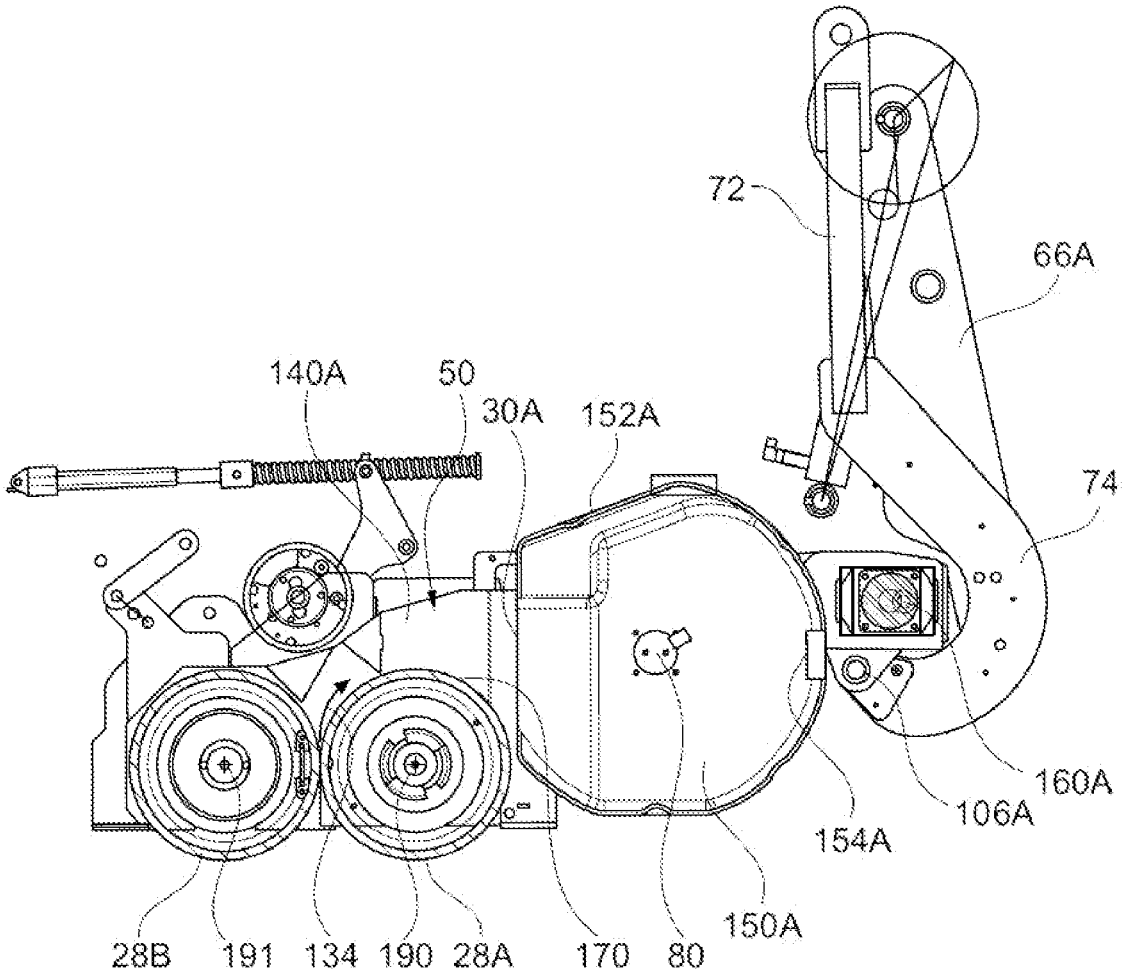
FIG. 17 is a side cross-sectional view of the high dump hopper system of FIG. 16 showing a cross-sectional view of the first debris hopper relative to the splitter.

Splitter 50 can be mounted to scrubber assembly 18 (see e.g., FIG. 1), or other structure attached thereto, to be proximate first debris hopper 20A and second debris hopper 20B. In an example, splitter 50 can be between first debris hopper 20A and second debris hopper 20B adjacent opening 30A and opening 30B. Splitter 50 can be positioned above or at least partially above first scrubber brush 28A, as can be seen in FIG. 17. Splitter 50 can comprise a body shaped and positioned to direct debris 134 originating from between first scrubber brush 28A and second scrubber brush 28B into first debris hopper 20A and second debris hopper 20B. First debris hopper 20A and second debris hopper 20B can comprise separate containers that can be individually positioned to reduce the size of floor cleaning machine 10. For example, first debris hopper 20A and second debris hopper 20B can be separated by distance 136 to produce space 138. Space 138 can be provided to allow forward steered wheel 36 (see e.g., FIGS. 1 and 18) adequate area to turn. As such, it is not necessary for forward steered wheel 36 and first debris hopper 20A and second debris hopper 20B to occupy different longitudinal locations along the length of floor cleaning machine 10, e.g., wheel 36 does not need to be longitudinally in front of or behind first debris hopper 20A and second debris hopper 20B, thereby allowing floor cleaning machine 10 to be reduced in size. In other words, first debris hopper 20A and second debris hopper 20B can occupy the same lateral position relative to the longitudinal length of floor cleaning machine 10. Splitter 50 can bridge the gap between first debris hopper 20A and second debris hopper 20B to guide debris from first scrubber brush 28A and second scrubber brush 28B originating adjacent space 138 into first debris hopper 20A and second debris hopper 20B. Splitter 50 can comprise a wedge-shaped body having leading panels 140A and 140B that come together at an apex extending over first scrubber brush 28A. Leading panels 140A and 140B can join with coupling panels 142A and 142B that can be arranged parallel to each other to slide between first debris hopper 20A and second debris hopper 20B. Coupling panels 142A and 142B can form a sliding seal against edges of first debris hopper 20A and second debris hopper 20B forming opening 30A and opening 30B, respectively. Floor cleaning machine 10 can be provided with other bodies to facilitate moving of debris into first debris hopper 20A and second debris hopper 20B. For example, side wedge 143 can be coupled to chassis 14 or another suitable structural component of floor cleaning machine 10 direct debris into first debris hopper 20A. Side wedge 143 can facilitate the use of scrubbing assembly 18 being wider than the total cross-width of first debris hopper 20A and second debris hopper 20B. As such, first debris hopper 20A and second debris hopper 20B can be configured to be used with scrubbing assemblies of different widths.

First debris hopper 20A and second debris hopper 20B can comprise containers for storing debris 134 collected by first scrubber brush 28A and second scrubber brush 28B. As shown in FIG. 15, first debris hopper 20A and second debris hopper 20B can comprise rectangular portions 144A and 144B having scupper portions 146A and 146B, respectively. Rectangular portions 144A and 144B can have rectangular cross-sectional areas configured to, together, extend across at least a portion of, e.g., a majority of, the width of first scrubber brush 28A not covered by splitter 50. Rectangular portions 144A and 144B can be sized to be less than the widths needed to cover first scrubber brush 28A to allow distance 136 to be greater to allow more space for forward steered wheel 36. As such, scupper portions 146A and 146B can be provided to close that gap without interfering with forward steered wheel 36. Scupper portions 146A and 146B can comprise flared portions of first debris hopper 20A and second debris hopper 20B angled toward splitter 50 to form surfaces that extend generally parallel with leading panels 140A and 140B.

Rectangular portion 144A can comprise outer wall 148A, inner wall 150A and exterior wall 152A. Rectangular portion 144B can comprise outer wall 148B, inner wall 150B and exterior wall 152B. Outer wall 148A and inner wall 150A can comprise planar or flat walls that can be vertically oriented to facilitate rotation of first debris hopper 20A and second debris hopper 20B. Exterior wall 152A can comprise a curved or multi-faceted wall that connects inner wall 150A and inner wall 150B and that extends from one side of opening 30A to an opposite side of opening 30A. The shape of exterior wall 152A can match the perimeters of outer wall 148A and inner wall 150A. As can be seen in FIG. 17, the perimeters of outer wall 148A and inner wall 150A and the shape of exterior wall 152A can be round, oval, teardrop shaped, elliptical or the like to facilitate rotation about hopper axis 80. Rectangular portion 144B can be constructed similarly to rectangular portion 144A.

First debris hopper 20A and second debris hopper 20B can additionally include drain opening 154A and drain opening 154B, respectively. Drain opening 154A and drain opening 154B can comprise passages through the structure of first debris hopper 20A and second debris hopper 20B, such as exterior walls 152A and 152B. Drain opening 154A and drain opening 154B can comprise simple through-bores or bores that are provided with resealable openings, such as threaded caps or valves. Drain opening 154A and drain opening 154B can be located relative to opening 30A and opening 30B in locations to facilitate draining and prevent spillage during transport. For example, drain opening 154A and drain opening 154B can be located directly opposite opening 30A and opening 30B in embodiments where drain opening 154A and drain opening 154B are capped. Thus, first debris hopper 20A and second debris hopper 20B can be rotated such that opening 30A and opening 30B are positioned upwards in a transport mode to prevent spilling and when located over a proper disposal site, drain opening 154A and drain opening 154B can be opened to allow debris and liquid (such as a cleaning solution) to be drained from first debris hopper 20A and second debris hopper 20B. In other examples, drain opening 154A and drain opening 154B can comprise a plurality of small through bores positioned closer to opening 30A and opening 30B, and first debris hopper 20A and second debris hopper 20B can be tilted using drive system 29A and drive system 29B to allow liquid and debris to drain out of drain opening 154A and drain opening 154B.

Drive system 29A can comprise motor 160A, drive gear 162A, input gear 164A and position sensor 166A. Drive system 29B can comprise motor 160B, drive gear 162B, input gear 164B and position sensor 166B. Motor 160A can be located within the tubular structure of crossmember 76. Motor 160A can directly rotate drive gear 162A. First debris hopper 20A can be coupled to input gear 164A, which can be linked to drive gear 162A by a belt (not illustrated). Motor 160A can be electronically coupled to operator station 16 (see e.g., FIG. 1) such that an operator can actuate a control to activate motor 160A to cause drive gear 162A, which, via a belt, can cause rotation of input gear 164A to thereby cause first debris hopper 20A to rotate. Position sensor 166A can be used by controller 202 (see e.g., FIG. 19) to determine the orientation of first debris hopper 20A relative to hopper link 56. Drive system 29B can be configured similarly to drive system 29A. As discussed herein, operator station 16 can include a controller that can rotate first debris hopper 20A and second debris hopper 20B.

Figure 16:
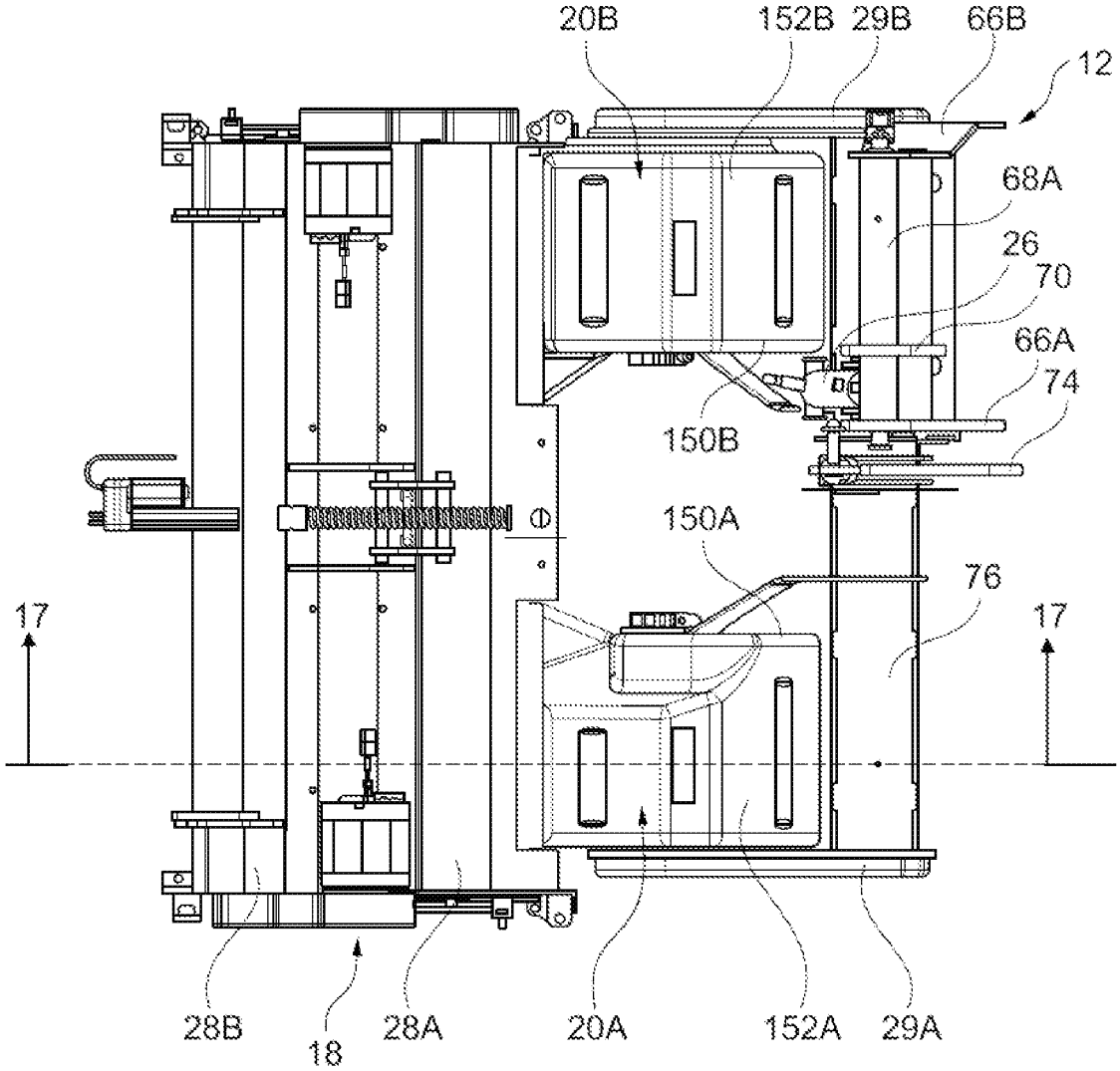
FIG. 16 is a top view of the high dump hopper system of FIG. 5.

FIG. 16 is a top view of high dump hopper system 12 of FIG. 14. FIG. 17 is a side cross-sectional view of high dump hopper system 12 of FIG. 16 showing a cross-sectional view of first debris hopper 20A relative to splitter 50. FIGS. 16 and 17 are discussed concurrently.

As discussed, first debris hopper 20A and second debris hopper 20B can comprise containers where exterior walls 152A and 152B are generally oval shaped to facilitate rotation on hopper axis 80. Opening 30A and opening 30B can comprise flat portions of first debris hopper 20A and second debris hopper 20B that truncate a portion of the oval shape of exterior walls 152A and 152B.

Splitter 50 can have a generally triangular cross-sectional profile with bottom surface 170 being contoured to fit over first scrubber brush 28A. In an example, bottom surface 170 can have the same radius of curvature as first scrubber brush 28A. Thus, splitter 50 can substantially reduce debris 134 from exiting between first scrubber brush 28A and second scrubber brush 28B and continuing under splitter 50 back to the floor surface.

In another example of the present disclosure, first debris hopper 20A and second debris hopper 20B and splitter 50 can be used without high dump hopper system 12. That is, first debris hopper 20A and second debris hopper 20B can be coupled, directly or indirectly, to chassis 14, and can be configured for manual emptying. For example, first debris hopper 20A and second debris hopper 20B can be mounted on rails for sliding onto floor cleaning machine 10. In an example, first debris hopper 20A and second debris hopper 20B can be configured to slide parallel to hopper axis 80. In such configurations, first debris hopper 20A and second debris hopper 20B can be locked into place to prevent lateral displacement parallel to hopper axis 80, but can be unlocked to slide off of the rails by an operator such that the operator can carry first debris hopper 20A and second debris hopper 20B to a refuse container. In such configurations, crossmember 76 or a structural element similar thereto, can be used to secure hoppers, such as by providing a rigid structure that can support first debris hopper 20A and second debris hopper 20B similarly to how disclosed herein. As such, frame 24, actuator 26, lift link 54 and follower link 52 can be eliminated, or disabled, and crossmember 76 can be secured and immobilized with respect to chassis 14 or some other such similar structure can be used to support first debris hopper 20A and second debris hopper 20B.

Figure 18:
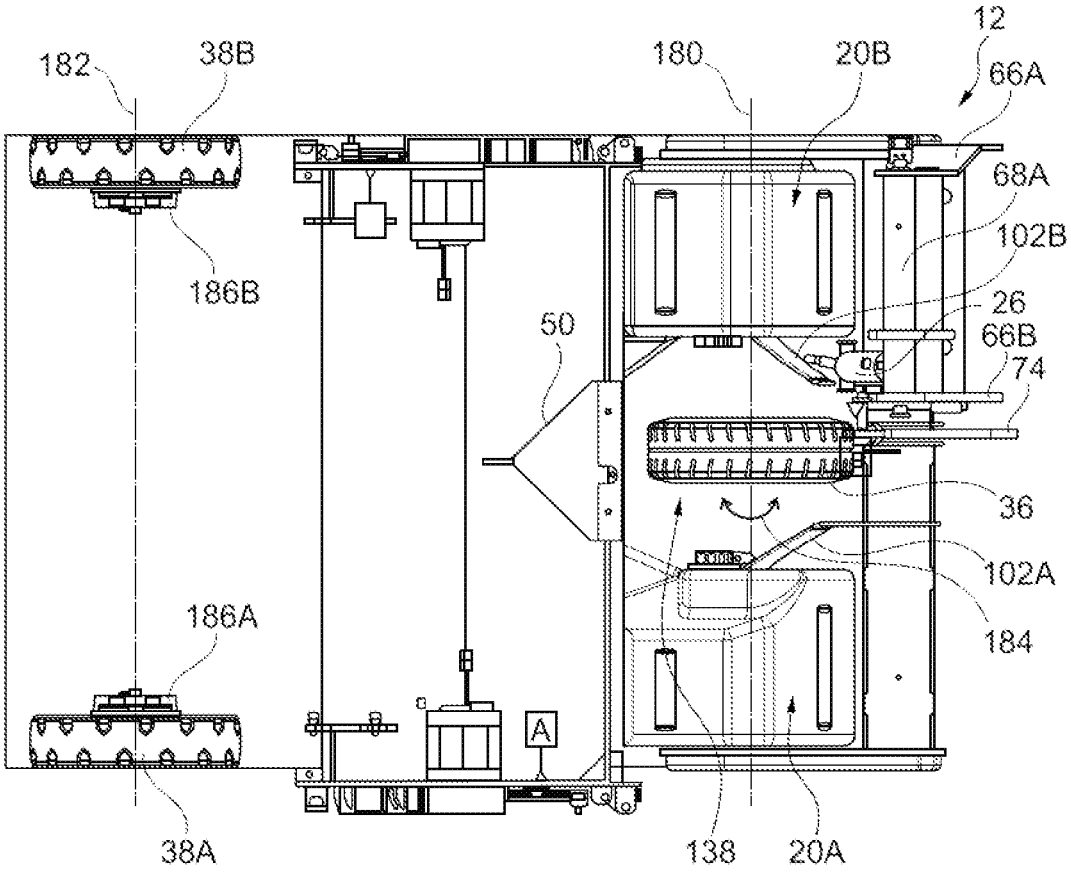
FIG. 18 is a top view of a chassis for the floor cleaning machine of FIG. 5 showing a front steered wheel between the first and second debris hoppers.

FIG. 18 is a top view of chassis 14 for floor cleaning machine 10 of FIG. 5 showing forward steered wheel 36 between first debris hopper 20A and second debris hopper 20B, and rear wheel 38A and rear wheel 38B. Forward steered wheel 36 can be configured to rotate on forward axis 180. Rear wheel 38A and rear wheel 38B can be configured to rotate on rear axis 182. Forward steered wheel 36 can be coupled to an axle of drive mechanism 40 and steering wheel 44 to cause rotation of forward steered wheel 36 about a steering axis 195 (see e.g., FIGS. 2 and 4) as indicated by arrow 184, e.g. this steering axis 195 is perpendicular to the forward axis 180 and it may be perpendicular or substantially perpendicular to a surface to be cleaned, when the floor cleaning machine 10 is in normal operation. Space 138 allows forward steered wheel 36 to turn around the steering axis 195 without being obstructed by first debris hopper 20A and second debris hopper 20B. Note, first hopper bracket 102A and second hopper bracket 102B can be located above space 138 for forward steered wheel 36. Rear wheel 38A and rear wheel 38B can be mounted to chassis 14 via brackets 186A and 186B. Brackets 186A and 186B can include axles upon which rear wheel 38A and rear wheel 38B can rotate about rear axis 182.

Figure 19:
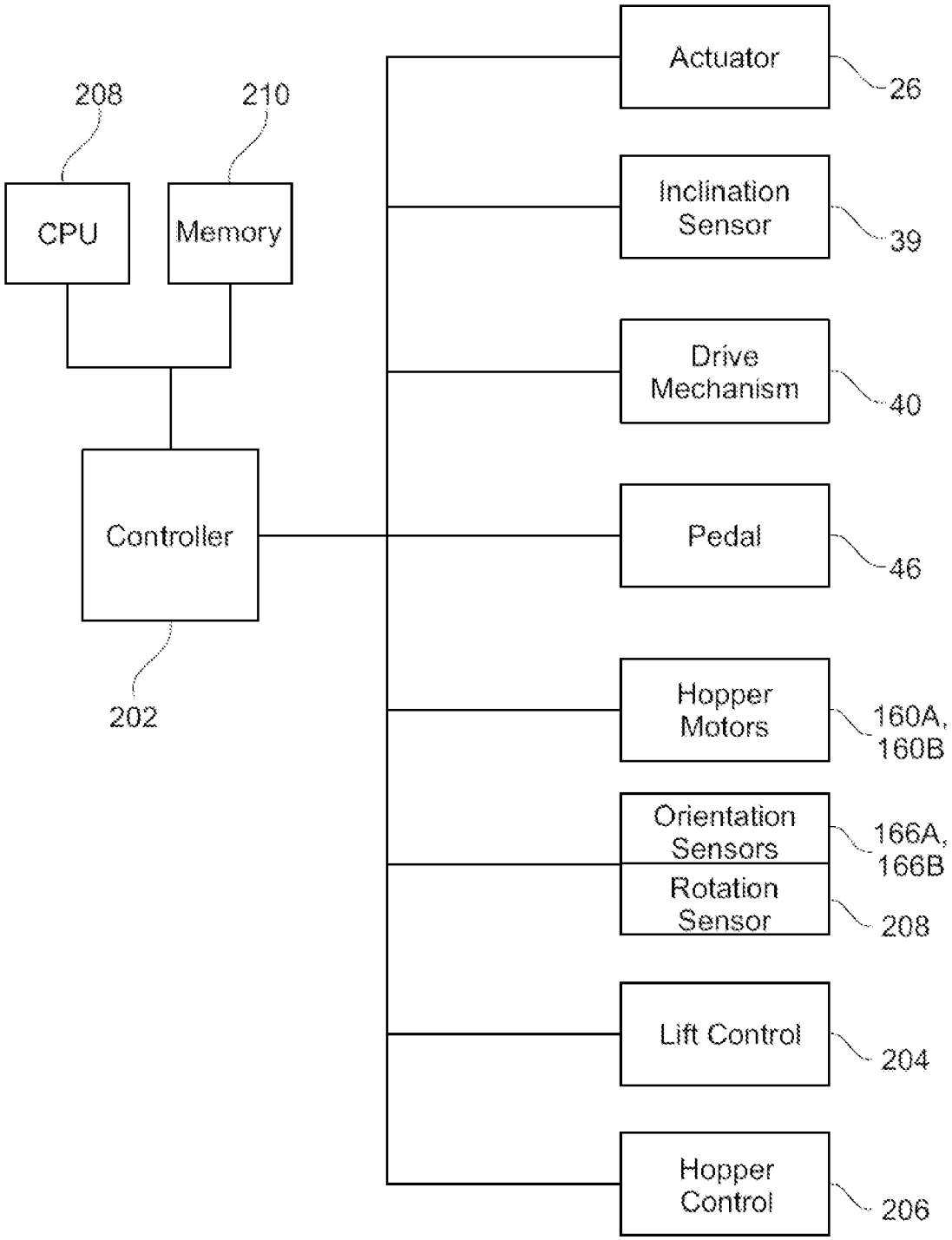
FIG. 19 is a block diagram of a control system for the floor cleaning machine of FIGS. 1-18 including various sensors and control component hardware.

FIG. 19 is a block diagram illustrating control system 200 for floor cleaning machine 10 of FIGS. 1-18. Control system 200 can comprise controller 202, actuator 26, inclination sensor 39, drive mechanism 40, pedal 46, motor 160A and motor 160B, position sensor 166A and position sensor 166B, lift control 204 and hopper control 206.

Controller 202 can comprise a computing system including processor 208 and memory 210. Controller 202 can comprise other hardware components, such as a network interface, a display device, an input device, an output device and a storage device that can include a machine-readable medium for storing instructions in which various commands for operating floor cleaning machine 10 can be located.

Controller 202 can operate high dump hopper system 12 in a plurality of modes to facilitate emptying, facilitate cleaning, prevent spills, prevent leakage and the like. In particular, controller 202 can operate to move first debris hopper 20A and second debris hopper 20B in high dump, tip-and-shake, tip-for-grade, tip-for-transport, dump-and-shake, tip-to-drain, and tip-for-brush-wear modes.

Controller 202 can operate high dump hopper system 12 in a high dump mode. In a high dump mode, controller 202 can operate actuator 26 to extend and move first debris hopper 20A and second debris hopper 20B from stowed position 122 (see e.g., FIG. 10) to extended position 124 (see e.g., FIG. 13). During such movement, controller 202 can operate motor 160A and motor 160B of drive system 29A and drive system 29B to maintain opening 30A and opening 30B in an upward orientation to prevent debris from falling out of first debris hopper 20A and second debris hopper 20B. Controller 202 can monitor the position of opening 30A and opening 30B by monitoring output of position sensor 166A and position sensor 166B. Further, actuator 26 can be provided with a position sensor so that the height of first debris hopper 20A and second debris hopper 20B along with the associated rotation of hopper link 56 produced by extension of actuator 26 can be determined by controller 202. In other words, controller 202 can determine the rotational orientation of first debris hopper 20A and second debris hopper 20B by determining the rotation of first debris hopper 20A and second debris hopper 20B produced by both rotation of lift link 54 and follower link 52 as well as rotation produced by motor 160A and motor 160B. In additional examples, controller 202 can be connected to rotation sensor 209 (see e.g., FIG. 5) to directly sense the orientation of first link 66A and second link 66B relative to frame 24.

Controller 202 can operate high dump hopper system 12 in a tip-and-shake mode. In a tip-and-shake mode, controller 202 can operate motor 160A and motor 160B to position opening 30A and opening 30B in an upward orientation and then rapidly move opening 30A and opening 30B in short back-and-forth movements to shake debris within first debris hopper 20A and second debris hopper 20B. The shaking movement can cause the debris to move further down into first debris hopper 20A and second debris hopper 20B (e.g., away from opening 30A and opening 30B). The tipping movement can improve filling of first debris hopper 20A and second debris hopper 20B. The tip-and-shake mode can occur in any position of first debris hopper 20A and second debris hopper 20B between stowed position 122 and extended position 124. In examples, controller 202 can tip-and-shake first debris hopper 20A and second debris hopper 20B in the fully stowed position or can withdraw first debris hopper 20A and second debris hopper 20B from engagement with first scrubber brush 28A only a short distance such that tipping and shaking of first debris hopper 20A and second debris hopper 20B will not cause impacting against first scrubber brush 28A.

Controller 202 can operate high dump hopper system 12 in a tip-for-grade mode. In a tip-for-grade mode, controller 202 can operate motor 160A and motor 160B to move the location of opening 30A and opening 30B to compensate for floor cleaning machine 10 traversing a floor or other terrain that is on an incline or a decline. Controller 202 can monitor output of inclination sensor 39 (see e.g., FIG. 1) to monitor the orientation of chassis 14. If floor cleaning machine 10 is sensed to be traversing an incline or a decline, controller 202 can rotate first debris hopper 20A and second debris hopper 20B to position opening 30A and opening 30B close to horizontal to compensate for the incline or decline and prevent debris from falling out of first debris hopper 20A and second debris hopper 20B. Tip-for-grade mode can occur during cleaning operations where first scrubber brush 28A and second scrubber brush 28B are actively cleaning or during transportation operations where first debris hopper 20A and second debris hopper 20B are partially or fully withdrawn from the stowed position for emptying.

Controller 202 can operate high dump hopper system 12 in a tip-for-transport mode. In a tip-for-transport mode, controller 202 can operate motor 160A and motor 160B to move the location of opening 30A and opening 30B to compensate for floor cleaning machine 10 traversing a floor or other terrain at speeds more suited for moving floor cleaning machine 10 than cleaning with scrubber assembly 18, which are typically higher. Controller 202 can monitor output of drive mechanism 40 (see e.g., FIG. 1) to monitor speed of floor cleaning machine 10. If floor cleaning machine 10 is sensed to be moving at a high rate of speed, higher than those at which cleaning operations occur, controller 202 can rotate first debris hopper 20A and second debris hopper 20B to position opening 30A and opening 30B upward to compensate for the increased bouncing and vibration of debris within first debris hopper 20A and second debris hopper 20B to prevent debris from falling out of first debris hopper 20A and second debris hopper 20B. In additional examples, controller 202 can be provided with an operator input to allow an operator to enable floor cleaning machine 10 to enter a transport mode where controller 202 can be notified that a cleaning mode is disabled and first scrubber brush 28A and second scrubber brush 28B are not operating.

Controller 202 can operate high dump hopper system 12 in a dump-and-shake mode. In a dump-and-shake mode, controller 202 can operate motor 160A and motor 160B to move the location of opening 30A and opening 30B to facilitate emptying of first debris hopper 20A and second debris hopper 20B. Controller 202 can monitor output of actuator 26 (see e.g., FIG. 1) to ascertain if floor cleaning machine 10 might be performing an emptying operation. Typically, an emptying operation can occur with first debris hopper 20A and second debris hopper 20B in the fully deployed position of extended position 124 (see e.g., FIG. 13). If floor cleaning machine 10 is determined to be in an emptying operation, controller 202 can rotate first debris hopper 20A and second debris hopper 20B to position opening 30A and opening 30B downward. Once opening 30A and opening 30B are in a downward position, controller 202 can rapidly move opening 30A and opening 30B in short back-and-forth movements to shake debris within first debris hopper 20A and second debris hopper 20B out of opening 30A and opening 30B.

Controller 202 can operate high dump hopper system 12 in a tip-to-drain mode. In a tip-to-drain mode, controller 202 can operate motor 160A and motor 160B to move the location of drain opening 154A and drain opening 154B to facilitate draining of first debris hopper 20A and second debris hopper 20B. Controller 202 monitor if floor cleaning machine 10 might be performing a draining operation. Typically, tip-to-drain operations can occur automatically during a cleaning process without prompting from an operator in short increments that do not substantially interfere with the cleaning operation. In examples, a draining operation can occur with first debris hopper 20A and second debris hopper 20B in or near the fully stowed position 122 (see e.g., FIG. 10). In other configurations, floor cleaning machine 10 can be determined to be in a draining operation by controller 202 and controller 202 can rotate first debris hopper 20A and second debris hopper 20B to position drain opening 154A and drain opening 154B downward to allow liquid within first debris hopper 20A and second debris hopper 20B to drain out of drain opening 154A and drain opening 154B. Drain operations can be used to facilitate cleaning of first debris hopper 20A and second debris hopper 20B, such as when water or another cleaning liquid is sprayed into first debris hopper 20A and second debris hopper 20B for rinsing. Drain operations can also be used in examples where floor cleaning machine 10 is configured as a scrubber or combination sweeper-scrubber where a cleaning fluid is recovered from the floor being cleaned.

Controller 202 can operate high dump hopper system 12 in a tip-for-brush-wear mode. In a tip-for-brush-wear mode, controller 202 can rotate first debris hopper 20A and second debris hopper 20B based on wear of first scrubber brush 28A and second scrubber brush 28B. In examples, first scrubber brush 28A and second scrubber brush 28B can comprise bristles extending radially outward to sweep debris into first debris hopper 20A and second debris hopper 20B to contact the floor being cleaned. Over time, it is possible for the bristles to become worn such that they become shorter than their initial length. As such, a gap can form between first debris hopper 20A and second debris hopper 20B and first scrubber brush 28A, thereby producing a gap through which swept-up debris can escape back down to the floor surface and diminishing the cleaning performance of floor cleaning machine 10. The condition of the bristles can be visually inspected by an operator of floor cleaning machine 10 or by the presence of a contact sensor on first debris hopper 20A and second debris hopper 20B that can be configured to sense engagement with the bristles. When a gap between the bristles and first debris hopper 20A and second debris hopper 20B is detected, controller 202 can tilt first debris hopper 20A and second debris hopper 20B so that an edge of opening 30A and opening 30B moves toward first scrubber brush 28A. Due to opening 30A and opening 30B being planar, rotation about hopper axis 80 will cause one edge of openings 30A to move away from first scrubber brush 28A and the opposite edge to move closer to first scrubber brush 28A. Thus, for example, with reference to FIG. 17, first debris hopper 20A and second debris hopper 20B can be rotated clock-wise (or in other configurations, counter-clock-wise) to move the lower edge of opening 30A and opening 30B toward first scrubber brush 28A. Furthermore, swing arms for first scrubber brush 28A and second scrubber brush 28B can be moved to bring second scrubber brush 28B closer to first debris hopper 20A and second debris hopper 20B because the scrub deck for first scrubber brush 28A and second scrubber brush 28B and first debris hopper 20A and second debris hopper 20B, via linkage system 22, are independently mounted to chassis 14.

In embodiments, controller 202 may operate as a stand-alone device or may be connected (e.g., networked) to other machines. In a networked deployment, controller 202 may operate in the capacity of a server machine, a client machine, or both in server-client network environments. In an example, controller 202 may act as a peer machine in peer-to-peer (P2P) (or other distributed) network environment. Controller 202 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Controller 202 may include processor 208 (e.g., a central processing unit (CPU), a graphics processing unit (GPU), a hardware processor core, or any combination thereof), memory 210 and static memory, some or all of which may communicate with each other via an interlink (e.g., bus). Controller 202 may further include a display unit, an alphanumeric input device (e.g., a keyboard), and a user interface (UI) navigation device (e.g., a mouse). In an example, the display unit, input device and UI navigation device may be a touch screen display. Controller 202 may additionally include a storage device (e.g., drive unit), a signal generation device (e.g., a speaker), a network interface device, and one or more sensors, such as a global positioning system (GPS) sensor, compass, accelerometer, or other sensor. Controller 202 may include an output controller, such as a serial (e.g., Universal Serial Bus (USB), parallel, or other wired or wireless (e.g., infrared (IR), near field communication (NFC), etc.) connection to communicate or control one or more peripheral devices (e.g., a printer, card reader, etc.).

The storage device may include machine readable medium on which is stored one or more sets of data structures or instructions (e.g., software) embodying or utilized by any one or more of the techniques or functions described herein. The instructions may also reside, completely or at least partially, within memory 210, within static memory, or within processor 208 during execution thereof by controller 202. In an example, one or any combination of processor 208, memory 210, static memory, or storage device may constitute machine readable media.

While memory 210 is illustrated as a single medium, the term "machine readable medium" may include a single medium or multiple media (e.g., a centralized or distributed database, and/or associated caches and servers) configured to store the one or more instructions. The term "machine readable medium" may include any medium that is capable of storing, encoding, or carrying instructions for execution by controller 202 and that cause controller 202 to perform any one or more of the techniques of the present disclosure (high dump, tip-and-shake, tip-for-grade, tip-for-transport, dump-and-shake, tip-to-drain, tip-for-brush-wear and the like), or that is capable of storing, encoding or carrying data structures used by or associated with such instructions. Non-limiting machine readable medium examples may include solid-state memories, and optical and magnetic media.

The instructions may further be transmitted or received over a communications network using a transmission medium via a network interface device utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device may include one or more physical jacks (e.g., Ethernet, coaxial, or phone jacks) or one or more antennas to connect to a communications network. In an example, the network interface device may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by machine 1700, and includes digital or analog communications signals or other intangible medium to facilitate communication of such software.

In the following, a set of high dump embodiments will be described.

A1. A floor cleaning machine comprising: a chassis comprising: a forward end; a rear end; an upper side extending between the forward end and the rear end; and an underside extending between the forward end and the rear end opposite the upper side; an operator station mounted on the upper side; a propulsion system located on the chassis and configured to move the chassis in a travel direction, the propulsion system comprising: a forward wheel located on a forward axis coupled to the underside of the chassis; and a rear wheel located on a rear axis coupled to the underside of the chassis; a brush coupled to the underside of the chassis, the brush extending from a first brush end to a second brush end along a brush axis, wherein the brush is configured to rotate about the brush axis; a hopper system located to the chassis, the hopper system comprising a first debris hopper disposed forward of the brush in a stowed position; and a lift system coupled to the chassis, the lift system comprising: a lift link pivotably coupled to the chassis proximate a first end of the lift link and pivotably coupled to the first debris hopper proximate a second end of the lift link; and a first actuator coupled to the chassis proximate a third end of the first actuator and the lift link proximate a fourth end of the first actuator, the first actuator configured to move the first debris hopper from the stowed position to a deployed position in front of and above the chassis.

A2. The floor cleaning machine of A1, wherein the brush axis is perpendicular to the travel direction.

A3. The floor cleaning machine of A1, wherein the brush is located between the forward axis and the rear axis.

A4. The floor cleaning machine of A3, wherein the first debris hopper is located adjacent the forward axis.

A5. The floor cleaning machine of A4, wherein the hopper system further comprises a second debris hopper located adjacent the forward axis.

A6. The floor cleaning machine of A5, wherein the first debris hopper and the second debris hopper are spaced apart alongside the forward axis to provide space that allows the forward wheel to turn.

A7. The floor cleaning machine of A5, wherein the lift system further comprises: a crossmember to which the first debris hopper and the second debris hopper are mounted, the crossmember comprising a front end and a back end; wherein the second end of the lift link is pivotably connected proximate the front end of the crossmember; and wherein the first debris hopper and the second debris hopper are connected proximate the back end of the crossmember.

A8. The floor cleaning machine of A7, wherein the lift system further comprises a follower link pivotably coupled to the chassis proximate a fifth end of the follower link and pivotably coupled to the crossmember proximate a sixth end of the follower link.

A9. The floor cleaning machine of A8, wherein the follower link comprises: a straight first section extending from the first end; and a curved second section extending from the first straight section and extending to the second end.

A10. The floor cleaning machine of A9, wherein the follower link comprises: a straight third section extending from the fifth end; and a curved fourth section extending from the straight third section and extending to the sixth end.

A11. The floor cleaning machine of A8, wherein a straight-line distance of the follower link between pivot points is greater than a straight-line distance of the lift link between pivot points.

A12. The floor cleaning machine of A11, wherein: the first end of the lift link is coupled to the chassis forward of the fifth end of the follower link; and the second end of the lift link is coupled to the cross member at a different position from the sixth end of the follower link.

A13. The floor cleaning machine of A7, further comprising a second actuator connecting the crossmember and the lift link.

A14. The floor cleaning machine of A5, wherein the first debris hopper and the second debris hopper extend across less than a width of the brush.

A15. The floor cleaning machine of A14, further comprising a splitter positioned above and in front of the brush between the first debris hopper and the second debris hopper, the splitter configured to push debris from the brush that is below and behind the splitter into the first and second debris hoppers.

A16. The floor cleaning machine of A15, wherein the splitter comprises: a wedge-shaped body spanning a distance between the first debris hopper and the second debris hopper.

A17. The floor cleaning machine of A15, further comprising a motor mounted to the hopper system, the motor configured to rotate the first and second debris hoppers about a hopper axis.

A18. The floor cleaning machine of A17, wherein the first and second debris hoppers each comprise: a first end wall; a second end wall spaced from the first end wall along the hopper axis; and a hopper wall extending between the first end wall and the second end wall to define a debris space; wherein the hopper wall defines a cross-sectional area configured to permit the first debris hopper to rotate in place along the hopper axis when rotated by the motor in the stowed position.

A19. The floor cleaning machine of A18, wherein the first and second debris hoppers each comprise a scupper configured to extend from the first end wall toward the wedge-shaped body to provide clearance for the forward wheel.

A20. The floor cleaning machine of A18, wherein the first and second debris hoppers each further comprise: an access opening extending between the first end wall and the second end wall; and a lip extending along the access opening and extending toward the brush in the stowed position.

A21. The floor cleaning machine of A1, wherein the chassis comprises a frame for locating the first end of the lift link above the upper side of the chassis.

A22. The floor cleaning machine of A1, wherein the lift link is located laterally of the operator station.

A23. The floor cleaning machine of A1, wherein the operator station is located on the upper side of the chassis above or forward of the brush.

A24. The floor cleaning machine of A1, wherein the lift system is configured to pull the first debris hopper along a first trajectory in a forward direction and then along a second trajectory in a forward and upward direction.

A25. The floor cleaning machine of A1, further comprising: a scrubbing system disposed on the chassis, the scrubbing system comprising: a cleaning fluid tank; a distribution system for receiving and dispensing cleaning fluid from the fluid tank to the brush; a recovery system for capturing cleaning fluid from behind the brush; and a recovery container for receiving cleaning fluid from the recovery system.

A26. The floor cleaning machine of A1, further comprising an additional brush coupled to the chassis and positioned alongside the brush, wherein the additional brush and the brush are configured to lift debris between them.

In the following, a set of splitter embodiments will be described.

B1. A floor cleaning machine comprising: a chassis comprising: a forward end; a rear end; an upper side extending between the forward end and the rear end; and an underside extending between the forward end and the rear end opposite the upper side; an operator station mounted on the upper side; a propulsion system located to the chassis and configured to move the chassis in a travel direction, the propulsion system comprising: a forward wheel located on a forward axis coupled to the underside of the chassis; and a rear wheel located on a rear axis coupled to the underside of the chassis; a brush coupled to the underside of the chassis, the brush extending from a first brush end to a second brush end along a brush axis, wherein the brush is configured to rotate about the brush axis; a hopper system located to the chassis, the hopper system comprising first and second debris hoppers disposed forward of the brush; and a splitter positioned above and in front of the brush between the first debris hopper and the second debris hopper, the splitter configured to push debris from the brush behind the splitter into the first and second debris hoppers.

B2. The floor cleaning machine of B1, wherein the first and second debris hoppers are configured to be slid laterally away from the chassis.

B3. The floor cleaning machine of B1, further comprising a lift system configured to pull the first and second debris hoppers along a first trajectory in a forward direction and then along a second trajectory in a forward and upward direction.

B4. The floor cleaning machine of B3, wherein the first trajectory extends from under the chassis to in front of the chassis.

B5. The floor cleaning machine of B1, wherein the brush axis is perpendicular to the travel direction.

B6. The floor cleaning machine of B1, wherein the brush is located between the forward axis and the rear axis.

B7. The floor cleaning machine of B1, wherein the operator station is located on the upper side of the chassis forward of the rear axis.

B8. The floor cleaning machine of B1, wherein the first and second debris hoppers are located adjacent the forward axis.

B9. The floor cleaning machine of B8, wherein the first debris hopper and the second debris hopper are spaced apart alongside the forward axis to provide space that allows the forward wheel to turn.

B10. The floor cleaning machine of B1, wherein the first debris hopper and the second debris hopper extend across less than a width of the brush.

B11. The floor cleaning machine of B10, wherein the splitter comprises: a wedge-shaped body spanning a distance between the first debris hopper and the second debris hopper.

B12. The floor cleaning machine of B11, wherein the wedge-shaped body comprises: first and second leading panels that come together to define an apex; first and second coupling panels extending from the first and second leading panels, respectively, wherein the first and second coupling panels are parallel to teach other; and a bottom wall that is curved to fit over the brush.

B13. The floor cleaning machine of B11, wherein the first debris hopper and the second debris hopper each comprise: a first end wall; a second end wall spaced from the first end wall along the hopper axis; and a hopper wall extending between the first end wall and the second end wall to define a debris space.

B14. The floor cleaning machine of B13, wherein the first and second debris hoppers each further comprise a scupper configured to extend from the first end wall toward the wedge-shaped body to provide clearance for the forward wheel.

B15. The floor cleaning machine of B13, wherein the first and second debris hoppers each further comprises: an access opening extending between the first end wall and the second end wall; and a lip extending along the access opening and extending toward the brush.

B16. The floor cleaning machine of B1, further comprising: a scrubbing system disposed on the chassis, the scrubbing system comprising: a cleaning fluid tank; a distribution system for receiving and dispensing cleaning fluid from the fluid tank to the brush; a recovery system for capturing cleaning fluid from behind the brush; and a recovery a container for receiving cleaning fluid from the recovery system.

In the following, a set of hopper control embodiments will be described.

C1. A floor cleaning machine comprising: a chassis comprising: a forward end; a rear end; an upper side extending between the forward end and the rear end; and an underside extending between the forward end and the rear end opposite the upper side; an operator station mounted on the upper side; a propulsion system located on the chassis and configured to move the chassis in a travel direction, the propulsion system comprising: a forward wheel located on a forward axis coupled to the underside of the chassis; and a rear wheel located on a rear axis coupled to the underside of the chassis; a brush coupled to the underside of the chassis, the brush extending from a first brush end to a second brush end along a brush axis, wherein the brush is configured to rotate about the brush axis; a hopper system located on the chassis, the hopper system comprising a first debris hopper disposed forward of the brush in a stowed position; a motor for rotating the first debris hopper about a hopper axis; and a controller coupled to the motor to control rotation of the first debris hopper.

C2. The floor cleaning machine of C1, further comprising a lift system coupled to the chassis, the lift system comprising: a lift link pivotably coupled to the chassis proximate a first end of the lift link and pivotably coupled to the first debris hopper proximate a second end of the lift link; and a first actuator coupled to the chassis proximate a third end of the first actuator and the lift link proximate a fourth end of the first actuator, the first actuator configured to move the first debris hopper from the stowed position to a deployed position in front of and above the chassis; wherein the controller is coupled to the first actuator to control operation of the lift system.

C3. The floor cleaning machine of C2, wherein the lift system further comprises a position sensor to determine an orientation of the first debris hopper about the hopper axis.

C4. The floor cleaning machine of C3, wherein the first debris hopper comprises: a first end wall; a second end wall spaced from the first end wall along the hopper axis; a hopper wall extending between the first end wall and the second end wall to define a debris space; and an access opening extending between the first end wall and the second end wall.

C5. The floor cleaning machine of C4, wherein the controller is configured to operate the motor to oscillate the first debris hopper on the hopper axis in the stowed position to move debris into the debris space with the access opening tilted toward the brush.

C6. The floor cleaning machine of C4, wherein the controller is configured to operate the motor to oscillate the first debris hopper on the hopper axis in the stowed position to move debris into the debris space with the access opening tilted upward.

C7. The floor cleaning machine of C4, wherein the lift system further comprises an inclination sensor to sense an inclination of the chassis, wherein the controller is configured to operate the motor to rotate the first debris hopper on the hopper axis in response to output of the inclination sensor.

C8. The floor cleaning machine of C7, wherein the controller is configured to operate the motor to rotate the first debris hopper to maintain the access opening at a top of the first debris hopper.

C9. The floor cleaning machine of C4, wherein the first debris hopper further comprises a drain opening in the hopper wall opposite the access opening.

C10. The floor cleaning machine of C9, wherein the controller is configured to operate the motor to rotate the first debris hopper to maintain the drain opening at a bottom of the first debris hopper.

C11. The floor cleaning machine of C4, wherein the controller is configured to operate the motor to rotate the first debris hopper to position the access opening at a bottom of the first debris hopper and to oscillate the first debris hopper while the access opening is positioned at the bottom.

C12. The floor cleaning machine of C1, wherein the controller is configured to operate the motor to rotate the first debris hopper to position the access opening relative to the brush depending on a diameter of the brush.

C13. The floor cleaning machine of C4, wherein the controller is configured to operate the motor to rotate the first debris hopper on the hopper axis as the first actuator moves the first debris hopper to maintain the access opening in an upward orientation.

C14. The floor cleaning machine of C4, wherein the controller is configured to: operate the motor to rotate the first debris hopper on the hopper axis to position the access opening in an upward orientation during a transportation operation wherein the brush is not rotating and the propulsion system is operating.

C15. The floor cleaning machine of C1, further comprising: a scrubbing system disposed on the chassis, the scrubbing system comprising: a cleaning fluid tank; a distribution system for receiving and dispensing cleaning fluid from the fluid tank to the brush; a recovery system for capturing cleaning fluid from behind the brush; and a recovery a container for receiving cleaning fluid from the recovery system.

The benefits of the systems and methods of the present disclosure can be in the form of, for example, 1) ease of operation in that an operator does not need to dismount the floor cleaning machine to empty the debris hoppers, 2) manual lifting of debris hoppers is eliminated, 3) overall length of the floor cleaning machine need not be increased in order to incorporate the lift system, 4) operator visibility is not obstructed by the lift system in the stowed position, 5) the debris hopper orientation can be automatically controlled during specific operations for improved performance, e.g., tip-and-shake, tip-for-grade, etc., 6), reduced spilling and re-sweeping of debris, 7) ease of maintenance on the debris hoppers including cleaning, 8) permitting front driving and steering of the machine, and 9) permitting of operator compartment to be located at the front of the machine. These and other benefits not specifically enumerated can be achieved with the high dump hopper system, controller and other components described herein.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

To sum up, the disclosure provides systems and methods include a high dump hopper system wherein a debris hopper can be split into two hoppers for positioning adjacent a wheel of the floor cleaning machine. The hoppers, split or not, can be located near the front of the machine such that the overall length of the floor cleaning machine need not be extended. A splitter can be positioned proximate the floor cleaning mechanism to drive debris into the split hoppers. The hoppers, split or not, can be coupled to a common lifting system that can pull the hoppers out from under a chassis of the floor cleaning machine and then upwards for positioning relative to a refuse container. Furthermore, the orientation of the hoppers can be controlled to position openings for the hoppers in a desired location to prevent spilling and facilitate emptying.

The invention claimed is:

1. A floor cleaning machine comprising:
- a chassis comprising:
  - a forward end;
  - a rear end;
  - an upper side extending between the forward end and the rear end; and
  - an underside extending between the forward end and the rear end opposite the upper side;
- an operator station mounted on the upper side;
- a propulsion system located on the chassis and configured to move the chassis in a travel direction, the propulsion system comprising:
  - a forward steered wheel located on a forward axis coupled to the underside of the chassis; and
  - a rear wheel located on a rear axis coupled to the underside of the chassis;
- a brush coupled to the underside of the chassis, the brush extending from a first brush end to a second brush end along a brush axis, wherein the brush is configured to rotate about the brush axis; and
- a hopper system located to the chassis, the hopper system comprising:
  - a first debris hopper
  - a second debris hopper; and
  - a linkage system for articulating the first and second debris hoppers between a stowed position and an extended position, the linkage system including:
    - a hopper link coupled to the first and second debris hoppers such that the first debris hopper and the second debris hopper are rotatable relative to the hopper link about a hopper axis,
    - a lift link arranged to rotate relative to the chassis about a lift link upper axis and rotatably coupled to the hopper link such that the hopper link can rotate relative to the lift link about a pivot axis,
  - wherein the stowed position includes:
    - the hopper axis located under the chassis,
    - the hopper axis is spatially between the brush axis and the forward end of the chassis, and
    - the lift link upper axis arranged forward of the hopper axis, and
  - wherein the extended position includes,
    - the hopper axis arranged forward of the lift link upper axis.

2. The floor cleaning machine of claim 1, wherein the first debris hopper and the second debris hopper are located adjacent the forward axis in the stowed position.

3. The floor cleaning machine of claim 1, wherein the first debris hopper and the second debris hopper are spaced apart to provide space in the stowed position that allows the forward steered wheel to turn.

4. The floor cleaning machine of claim 1, further comprising a splitter positioned above and in front of the brush between the first debris hopper and the second debris hopper when in the stowed position, the splitter configured to direct debris from the brush that is below and behind the splitter into the first debris hopper and the second debris hopper in the stowed position.

5. The floor cleaning machine of claim 4, wherein the splitter comprises a wedge-shaped body spanning a distance between the first debris hopper and the second debris hopper in the stowed position.

6. The floor cleaning machine of claim 5, wherein the wedge-shaped body comprises:
- a first leading panel and a second leading panel that come together to define an apex;
- a first coupling panel and a second coupling panel extending from the first and second leading panels, respectively, wherein the first coupling panel and the second coupling panel are parallel to each other; and
- a bottom wall that is curved to fit over the brush.

7. The floor cleaning machine of claim 5, wherein the first debris hopper and the second debris hopper each comprise:
- a first end wall;
- a second end wall spaced from the first end wall along the hopper axis;
- a hopper wall extending between the first end wall and the second end wall to define a debris space; and
- a scupper configured to extend from the first end wall toward the wedge-shaped body of the splitter to provide clearance for the forward steered wheel in the stowed position;
- wherein the hopper wall defines a cross-sectional area configured to permit the first debris hopper to rotate in place about the hopper axis when in the stowed position.

8. The floor cleaning machine of claim 1, wherein the first debris hopper and the second debris hopper each comprise:
- a first end wall;
- a second end wall spaced from the first end wall along the hopper axis; and
- a hopper wall extending between the first end wall and the second end wall to define a debris space; and
- wherein the hopper wall defines a cross-sectional area configured to permit the first debris hopper to rotate in place about the hopper axis when in the stowed position.

9. The floor cleaning machine of claim 8, wherein the first debris hopper and the second debris hopper each further comprise:
- an access opening extending between the first end wall and the second end wall; and
- a lip extending along the access opening and extending toward the brush in the stowed position.

10. The floor cleaning machine of claim 8, wherein the first debris hopper and the second debris hopper each further comprise an access opening extending between the first end wall and the second end wall.

11. The floor cleaning machine of claim 1, further comprising a motor mounted to the hopper system, the motor configured to rotate the first debris hopper and the second debris hopper about the hopper axis.

12. The floor cleaning machine of claim 1, further comprising:
- a first actuator coupled to the chassis proximate a first end of the first actuator and the lift link proximate a second end of the first actuator, the first actuator configured to move, via the linkage system, the first debris hopper from the stowed position to the extended position in front of and above the chassis;

wherein the hopper link includes a crossmember to which the first debris hopper and the second debris hopper are mounted, the crossmember comprising a front end and a back end;

wherein the lift link is pivotably connected to the hopper link proximate the front end of the crossmember; and wherein the first debris hopper and the second debris hopper are connected to the hopper link proximate the back end of the crossmember.

13. The floor cleaning machine of claim 12, further comprising a position sensor to arranged to detect an orientation of the first debris hopper about the hopper axis.

14. The floor cleaning machine of claim 12, wherein the linkage system is configured to pull the first debris hopper from the stowed position along a first trajectory in a forward direction and then along a second trajectory in a forward and upward direction.

15. The floor cleaning machine of claim 1, further comprising:

a scrubbing system disposed on the chassis, the scrubbing system comprising:

a cleaning fluid tank;

a distribution system for receiving and dispensing cleaning fluid from the cleaning fluid tank to the brush;

a recovery system for capturing cleaning fluid from behind brush; and a recovery container for receiving cleaning fluid from the recovery system.

16. The floor cleaning machine of claim 1, wherein the first debris hopper and the second debris hopper are configured to be slid, from the stowed position, laterally away from the chassis.

17. The floor cleaning machine of claim 1, comprising:

a motor for rotating the first debris hopper about the hopper axis; and a controller coupled to the motor to control rotation of the first debris hopper.

18. The floor cleaning machine of claim 17, further comprising:

wherein the first debris hopper comprises:

a first end wall;

a second end wall spaced from the first end wall along the hopper axis;

a hopper wall extending between the first end wall and the second end wall to define a debris space; and an access opening extending between the first end wall and the second end wall wherein the controller is configured to operate the motor to oscillate the first debris hopper about the hopper axis in the stowed position to move debris into the debris space with the access opening tilted upward or toward the brush.

19. The floor cleaning machine of claim 1, wherein the stowed position includes an entirety of each of the first and second debris hoppers tucked below the underside of the chassis.

20. The floor cleaning machine of claim 1, wherein the relative to the rear end of the chassis:

the stowed position includes the pivot axis arranged forward of the hopper axis; and the extended position includes the hopper axis arranged forward of the hopper axis.

21. The floor cleaning machine of claim 20, wherein the stowed position includes the hopper axis located below the lift link upper axis and the extended position includes the hopper axis located above the lift link upper axis.

22. A method for cleaning a floor, the method comprising:

a chassis comprising:

a forward end;

a rear end;

an upper side extending between the forward end and the rear end; and an underside extending between the forward end and the rear end opposite the upper side;

an operator station mounted on the upper side;

a propulsion system located on the chassis and configured to move the chassis in a travel direction, the propulsion system comprising:

a forward steered wheel located on a forward axis coupled to the underside of the chassis; and a rear wheel located on a rear axis coupled to the underside of the chassis;

a brush coupled to the underside of the chassis, the brush extending from a first brush end to a second brush end along a brush axis, wherein the brush is configured to rotate about the brush axis; and a hopper system located to the chassis, the hopper system comprising:

a first debris hopper, a linkage system for articulating the first and between a stowed position and an extended position, the linkage system including:

a hopper link coupled to the first and debris hopper such that the first debris hopper is rotatable relative to the hopper link about a hopper axis, a lift link arranged to rotate relative to the chassis about a lift link upper axis and rotatably coupled to the hopper link such that the hopper link is rotatable relative to the lift link about a pivot axis, wherein the stowed position includes the first debris hopper disposed forward of the brush, the hopper axis located under the chassis and spatially between the brush axis and the forward axis of the chassis;

wherein the forward axis is positioned in front of the brush axis;

operating the floor cleaning machine with the first debris hopper in the stowed position to clean an area of the floor; and operating the floor cleaning machine to articulate the first debris hopper from the stowed position to the extended position and to empty contents of the first debris hopper;

wherein the stowed position includes the hopper axis located below and behind the lift link upper axis, and the extended position includes the hopper axis located above and forward of the lift link upper axis.

* * * * *